US009122235B2

(12) United States Patent
Fukui et al.

(10) Patent No.: US 9,122,235 B2
(45) Date of Patent: Sep. 1, 2015

(54) PROCESS CARTRIDGE AND IMAGE FORMING APPARATUS WITH MEANS TO REGULATE MOVEMENT OF DEVELOPING UNIT WITH RESPECT TO DRUM UNIT IN AXIAL DIRECTION OF DEVELOPING ROLLER

(71) Applicant: CANON KABUSHIKI KAISHA, Tokyo (JP)

(72) Inventors: Yuichi Fukui, Yokosuka (JP); Noritomo Yamaguchi, Kawasaki (JP); Tatsuya Suzuki, Kawasaki (JP); Satoshi Nishiya, Yokohama (JP); Masaaki Sato, Yokohama (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,948

(22) Filed: Sep. 6, 2013

(65) Prior Publication Data

US 2014/0072335 A1 Mar. 13, 2014

(30) Foreign Application Priority Data

Sep. 11, 2012 (JP) ..... 2012-199359
Sep. 14, 2012 (JP) ..... 2012-203089

(51) Int. Cl.
*G03G 21/16* (2006.01)
*G03G 21/18* (2006.01)

(52) U.S. Cl.
CPC ..... *G03G 21/18* (2013.01); *G03G 21/1821* (2013.01); *G03G 21/1825* (2013.01)

(58) Field of Classification Search
None
See application file for complete search history.

(56) References Cited

U.S. PATENT DOCUMENTS 5,119,137 A * 6/1992 Katagata ..... 399/116
5,991,569 A 11/1999 Sugihara et al.
2002/0071693 A1 6/2002 Shimaoka
2006/0029423 A1 * 2/2006 Shiraki ..... 399/113

(Continued)

FOREIGN PATENT DOCUMENTS

JP H05-204233 A 8/1993
JP H09-50224 A 2/1997

(Continued)

OTHER PUBLICATIONS

U.S. Appl. No. 14/020,406, filed Sep. 6, 2013, Hiroyuki Munetsugu.

*Primary Examiner* — Clayton E Laballe
*Assistant Examiner* — Peter L Cheng
(74) *Attorney, Agent, or Firm* — Canon U.S.A., Inc. IP Division

(57) ABSTRACT

A process cartridge, wherein both in the case where the developing unit is at the contact position and in the case where the developing unit is at the separation position, a first regulating portion that the drum unit has and a first regulated portion that the developing unit has, are engaged with each other, whereby movement of the developing unit with respect to the drum unit in the axial direction of the developing roller is regulated, wherein in the case where the developing unit is at the separation position, a second regulating portion and a second regulated portion overlap each other in a direction perpendicular to the axial direction, and wherein in the case where the developing unit is at the contact position, the second regulating portion and the second regulated portion do not overlap each other in the direction perpendicular to the axial direction.

20 Claims, 23 Drawing Sheets

(56) References Cited

U.S. PATENT DOCUMENTS

| | | | | |
|---|---|---|---|---|
| 2008/0138109 | A1* | 6/2008 | Anan et al. | 399/113 |
| 2011/0274470 | A1* | 11/2011 | Miura | 399/269 |
| 2013/0051849 | A1* | 2/2013 | Itabashi et al. | 399/111 |

FOREIGN PATENT DOCUMENTS

| | | | |
|---|---|---|---|
| JP | 2001-066970 | A | 3/2001 |
| JP | 2008-261910 | A | 10/2008 |
| JP | 4280770 | B2 | 6/2009 |

* cited by examiner

PROCESS CARTRIDGE AND IMAGE FORMING APPARATUS WITH MEANS TO REGULATE MOVEMENT OF DEVELOPING UNIT WITH RESPECT TO DRUM UNIT IN AXIAL DIRECTION OF DEVELOPING ROLLER

BACKGROUND OF THE INVENTION

1. Field of the Invention

The present invention relates to an image forming apparatus, and a process cartridge detachably attachable to the apparatus main body of an image forming apparatus.

An image forming apparatus is an apparatus configured to form an image on a recording medium by employing the electrophotographic image forming process. Examples of the image forming apparatus include an electrophotographic copying machine, an electrophotographic printer (e.g., a laser beam printer or a light-emitting diode (LED) printer), a facsimile apparatus, and a word processor.

A process cartridge is configured to integrate into a cartridge an image bearing member on which a developer image is formed and at least a developer carrying member as a process unit acting on this image bearing member. The process cartridge is detachably attachable to the main body of an image forming apparatus.

The term "image forming apparatus main body (hereinafter referred to as the apparatus main body) refers to the portion of an image forming apparatus excluding the process cartridge.

2. Description of the Related Art

Conventionally, in the image forming apparatus, a process cartridge system is employed which is configured to integrate into a cartridge a photosensitive drum and a process unit acting on the photosensitive drum. The cartridge is detachably attachable to the apparatus main body.

According to this process cartridge system, the image forming apparatus can be maintained by the user himself without depending on a serviceman, which has achieved a substantial improvement in terms of operability. Thus, this process cartridge system is widely employed in image forming apparatuses.

The process cartridge is divided into a photosensitive drum unit having a photosensitive drum, and a developing unit having a developing roller. Further, the developing unit is capable of movement relative to the photosensitive drum unit.

As an electrophotographic developing system, there is available a contact developing system in which an image is formed with an elastic layer of the developing roller being held in contact with the surface of the photosensitive drum. In this contact developing system, at the time of image formation, the developing roller is in contact with the surface of the photosensitive drum at a predetermined pressure. In this system, when the elastic layer of the developing roller and the photosensitive drum are held in contact for a long period of time from the factory shipment of the process cartridge until its deliverance to the user, there is a fear that the elastic layer of the developing roller may undergo deformation.

As a result of this deformation, unevenness in development may be generated, and there is a fear that a defective image is generated. Further, regardless of the presence of the elastic layer of the developing roller, when the developing roller is kept in contact with the photosensitive drum during transportation, there is a fear that the developing roller surface and the photosensitive drum surface may slide-rub on each other as a result of vibration or shock during transportation, resulting in generation of rubbing marks on the developing roller surface and the photosensitive drum surface. Due to the rubbing marks, there is a fear that a defective image may be generated.

As a construction for solving the above problem, there is a mechanism for retaining, during transportation, the developing unit which holds the developing roller, at a position where the photosensitive drum and the developing roller are separated from each other. Japanese Patent Application Laid-Open No. 2008-261910 discusses a construction in which, at the time of factory shipment of the image forming apparatus with the process cartridge being attached thereto, a separation member for separating the developing roller and the photosensitive drum from each other is placed in the process cartridge (refer to FIG. 10, etc.)

According to Japanese Patent No. 4280770, an image forming apparatus has a mechanism which, when an image is being formed, holds a developing roller and a photosensitive drum in contact with each other, and which, when no image is being formed, separates the developing roller and the photosensitive drum from each other. In this construction, by separating the developing roller from the photosensitive drum, it is possible to suppress deformation of an elastic layer of the developing roller. Further, it is possible to suppress movement of developer from the developing roller to the photosensitive drum when no image is being formed.

In a conventional apparatus, the photosensitive drum unit retaining the photosensitive drum is provided with a regulating portion configured to regulate the position in the axial direction (hereinafter referred to as the longitudinal direction) of the photosensitive drum relative to the developing unit retaining the developing roller. Further, the developing unit is provided with a portion to be regulated. The regulating portion of the photosensitive drum unit and the regulated portion of the developing unit are fitted into each other, whereby the position of the developing unit relative to the photosensitive drum unit is maintained with high accuracy in a longitudinal direction of the developing unit.

However, if a large load is applied to the process cartridge due to vibration or shock during transportation while the developing roller and the photosensitive drum are separated from each other, a load is applied to the regulating portion of the photosensitive drum unit or to the regulated portion of the developing unit. Thus, there is a possibility that the regulating portion or the regulated portion undergoes damage. Or, if, in forming an image, the operation of bringing the developing roller and the photosensitive drum into and out of contact with each other is repeated, the regulating portion and the regulated portion may slidably rub on each other, so that there is a possibility that the regulating portion and the regulated portion may be worn away. When the regulating portion or the regulated portion is damaged or worn away, there is a possibility that the position of the developing unit relative to the photosensitive drum unit cannot be maintained in the longitudinal direction of the developing unit.

Thus, conventionally, to prevent such damage of the regulating portion and the regulated portion, there have been provided a regulating portion and a regulated portion of high strength capable of withstanding shock or wearing during transportation. For this purpose, the regulating portion, etc. has been enlarged or formed of a material of high strength. Thus, in some cases, a size of the process cartridge may be increased in order to secure the requisite space for providing a large regulating or regulated portion. In some cases, there have been limitations regarding the material and configuration of the regulating or regulated portion.

SUMMARY OF THE INVENTION

The present invention is directed to a simple construction which maintains high accuracy of the position of the developing unit with respect to the photosensitive drum unit in the longitudinal direction of the developing unit.

According to an aspect of the present invention, a process cartridge detachably attachable to an apparatus main body of an image forming apparatus, includes a drum unit having a photosensitive drum, and developing unit having a developing roller and connected to the drum unit such that the developing roller is movable between a contact position where the developing roller is held in contact with the photosensitive drum and a separation position where the developing roller is separated from the photosensitive drum, wherein both in the case where the developing unit is at the contact position and in the case where the developing unit is at the separation position, a first regulating portion that the drum unit has and a first regulated portion that the developing unit has, are engaged with each other, whereby the movement of the developing unit with respect to the drum unit in the axial direction of the developing roller is regulated, wherein the first regulating portion or the first regulated portion is a protrusion that protrudes in a direction crossing to the axial direction from either one of the drum unit and the developing unit to the other unit, wherein in the case where the developing unit is at the separation position, a second regulating portion that the drum unit has and a second regulated portion that the developing unit has, overlap each other in a direction perpendicular to the axial direction, and wherein in the case where the developing unit is at the contact position, the second regulating portion and the second regulated portion do not overlap each other in the direction perpendicular to the axial direction.

According to another aspect of the present invention, a process cartridge detachably attachable to an apparatus main body of an image forming apparatus, includes an image bearing member unit having an image bearing member, a developing unit having a developing roller and connected to the image bearing member unit such that the developing unit is movable between a contact position where the developing roller is held in contact with the image bearing member and a separation position where the developing roller is separated from the image bearing member, a regulating portion provided on the image bearing member unit, and regulated portion provided on the developing unit and configured to be engaged with the regulating portion to thereby regulate the movement of the developing unit in the axial direction of the developing roller, wherein a region of at least one of the regulating portion and the regulated portion which are engaged with each other is formed as a curved surface.

According to yet another aspect of the present invention, an image forming apparatus configured to form an image on a recording medium, includes a drum unit having a photosensitive drum, and developing unit having a developing roller and connected to the drum unit such that the developing unit is movable between a contact position where the developing roller is held in contact with the photosensitive drum and a separation position where the developing roller is separated from the photosensitive drum, wherein both in the case where the developing unit is at the contact position and in the case where the developing unit is at the separation position, a first regulating portion that the drum unit has and a first regulated portion that the developing unit has, are engaged with each other, whereby the movement of the developing unit with respect to the drum unit in the axial direction of the developing roller is regulated, wherein the first regulating portion or the first regulated portion is a protrusion that protrudes in a direction crossing to the axial direction from either one of the drum unit and the developing unit to the other unit, wherein in the case where the developing unit is at the separation position, a second regulating portion that the drum unit has and a second regulated portion that the developing unit has, overlap each other in a direction perpendicular to the axial direction, and wherein in the case where the developing unit is at the contact position, the second regulating portion and the second regulated portion do not overlap each other in the direction perpendicular to the axial direction.

According to yet another aspect of the present invention, an image forming apparatus configured to form an image on a recording medium, includes a drum unit having a photosensitive drum, a developing unit having a developing roller and connected to the drum unit such that the developing unit is movable between a contact position where the developing roller is held in contact with the photosensitive drum and a separation position where the developing roller is separated from the photosensitive drum, a regulating portion provided on the drum unit, and regulated portion provided on the developing unit and configured to be engaged with the regulating portion to thereby regulate the movement of the developing unit with respect to the drum unit in the axial direction of the developing roller, wherein at least one of the regulating portion and the regulated portion has a curved surface to be engaged with the other portion of the regulating portion and the regulated portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The first exemplary embodiment of the present invention will be described with reference to the drawings as follows. In the present exemplary embodiment described below, as the electrophotographic image forming apparatus of a process cartridge type, a full-color image forming apparatus is described, to which four process cartridges are detachably attachable. The number of process cartridges attached to the image forming apparatus is not restricted to four. The number is set as appropriate. For example, in the case of an image forming apparatus forming a monochrome image, the number of process cartridges attached to the image forming apparatus is one.

[Outline of the Image Forming Apparatus]

Figure 2:
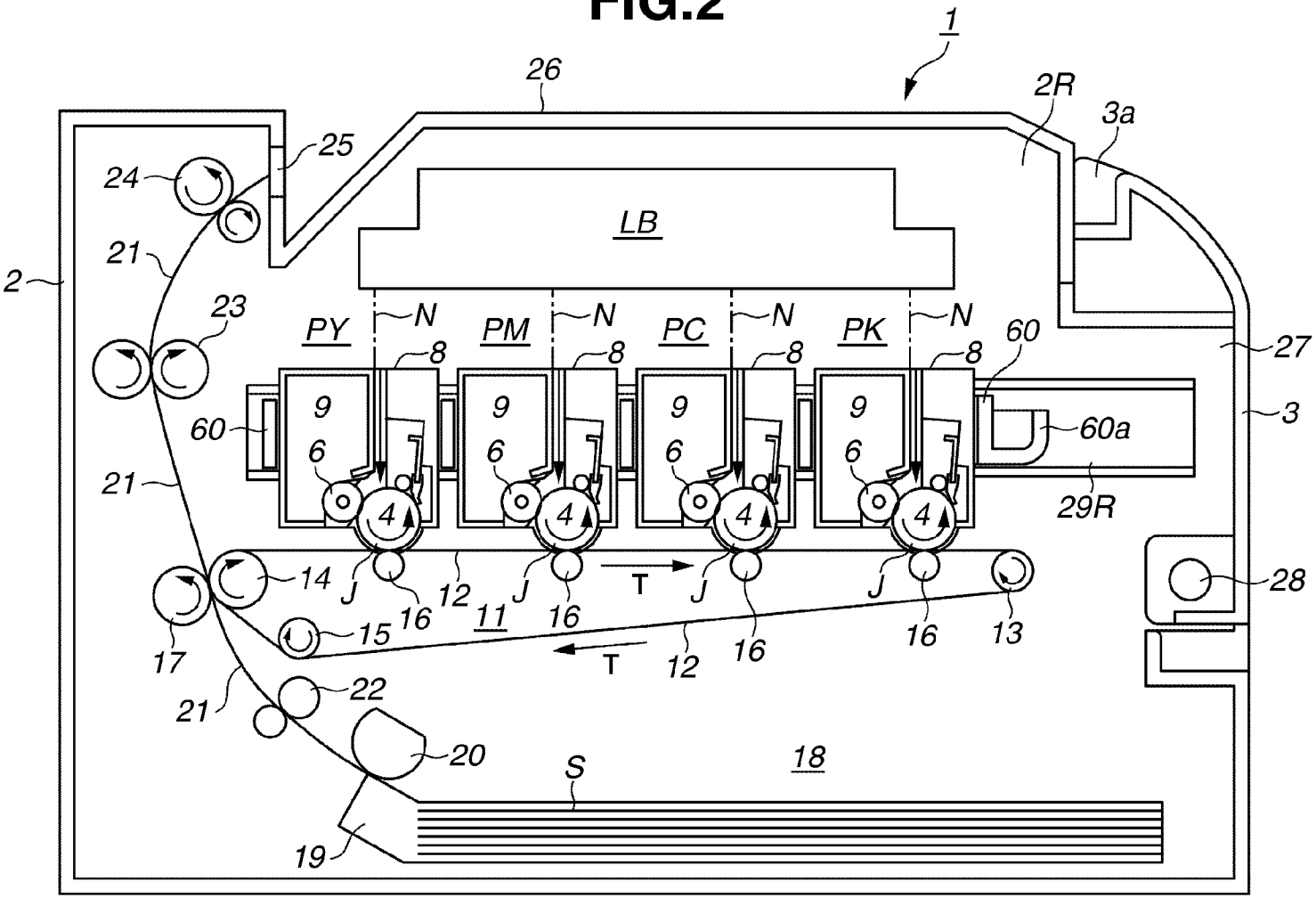
FIG. 2 is a sectional view of an image forming apparatus according to the first exemplary embodiment.

FIG. 2 is a schematic sectional view of an electrophotographic image forming apparatus according to the present exemplary embodiment. The image forming apparatus 1 is a four full-color laser printer employing the electrophotographic image forming process. That is, the image forming apparatus can form on a recording medium S a full-color image or a monochrome image corresponding to electronic image information input to a control unit (not illustrated) from a host apparatus (not illustrated) such as a personal computer. First through fourth process cartridges (hereinafter referred to as the cartridges) P (PY, PM, PC, and PK) are detachably attached to the electrophotographic image forming apparatus main body (hereinafter referred to as the apparatus main body) 2.

In the image forming apparatus 1 according the present exemplary embodiment, the side where a front door 3 is provided will be referred to as a front side (front surface), and the surface opposite the front side will be referred to as the back surface (rear surface). The right-hand side of the image forming apparatus 1 as seen from the front side will be referred to as a driving side, and the left-hand side of the same will be referred to as a non-driving side. FIG. 2 is a sectional view (right side longitudinal view) as seen from the non-driving (left) side of the image forming apparatus 1. The front side of the drawing is the non-driving side of the image forming apparatus 1, the right-hand side of the drawing is the front side of the image forming apparatus 1, the depth side of the drawing is the driving side of the image forming apparatus 1, and the left-hand side of the drawing is the rear side of the image forming apparatus 1.

Figure 4A:
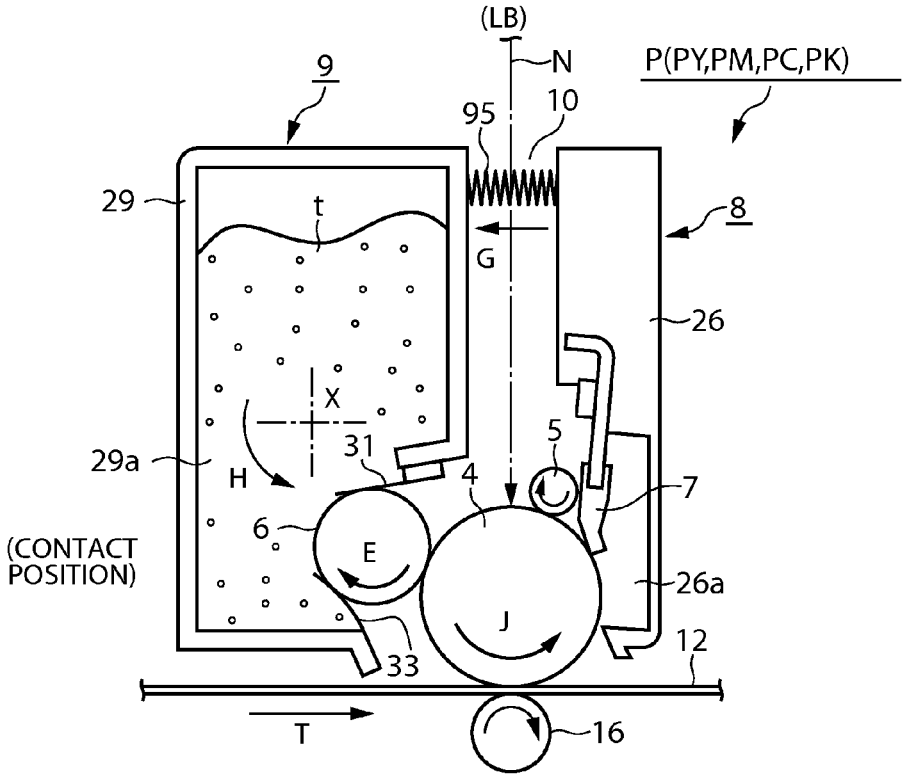
FIGS. 4A and 4B are sectional views of the process cartridge.

Inside the apparatus main body 2, there are horizontally arranged four cartridges P: a first cartridge PY, a second cartridge PM, a third cartridge PC, and a fourth cartridge PK, in that order from the rear side to the front side of the apparatus. The cartridges P have the same electrophotographic image forming process mechanism, and differ from each other in the color of the developer (toner). FIG. 4A is a partially enlarged view of one of the cartridges of FIG. 2.

A rotational drive force is transmitted to each cartridge P from a drive output unit (not illustrated) on the driving side of the apparatus main body 2. Further, bias voltage (charging bias, developing bias or the like) is supplied to each cartridge P from a bias output unit (not illustrated) on the driving side of the apparatus main body 2.

As illustrated in FIG. 4A, each cartridge P of the present exemplary embodiment has an image bearing member unit (hereinafter referred to as the drum unit) 8. The drum unit 8 is equipped with a photosensitive drum (hereinafter referred to as the drum) 4 as the image bearing member on which a developer image is formed, and a charging unit and a cleaning unit as processing units acting on the drum 4. As the charging unit, a charging roller 5 is employed, and, as the cleaning unit, a cleaning blade 7 is employed.

Further, each cartridge P has a developing unit 9 equipped with a development unit configured to develop an electrostatic latent image on the drum 4. A developing roller 6 is employed as the development unit. The developing roller 6 is a developer carrying member configured to carry developer on the surface thereof.

The drum unit 8 and the developing unit 9 are swingably connected to each other. The construction of the cartridge P will be described more specifically below.

The first cartridge PY stores within a developing frame member 29 yellow (Y) developer t, and is configured to form a yellow developer image on the surface of the drum 4. The second cartridge PM stores within the developing frame member 29 magenta (M) developer t, and is configured to form a magenta developer image on the surface of the drum 4. The third cartridge PC stores within the developing frame member 29 cyan (C) developer t, and is configured to form a cyan developer image on the surface of the drum 4. The fourth cartridge PK stores within the developing frame member 29 black (K) developer t, and is configured to form a black developer image on the surface of the drum 4.

A laser scanner unit LB as the image exposure unit is provided above the first through fourth cartridges P (PY, PM, PC, and PK). This unit LB outputs a laser beam N modulated in correspondence with image information. The laser beam N passes through exposure window portions 10 of the cartridges P to expose the surfaces of the drums 4 by scanning. The exposure window portion 10 is a gap portion formed between the drum unit 8 and the developing unit 9.

An intermediate transfer belt unit 11 as a transfer member is provided under the first through fourth cartridges P (PY, PM, PC, and PK). This unit 11 has a driving roller 13 arranged on the fourth cartridge PK side, and a secondary transfer opposing roller 14 and a tension roller 15 arranged on the first cartridge PY side. A flexible transfer belt 12 is stretched between these three rollers 13, 14, and 15.

The lower surface of the drum 4 of each cartridge P is in contact with the upper surface of a higher belt portion between the rollers 13 and 14 of the transfer belt 12. The contact portion between each drum 4 and the belt 12 constitutes a primary transfer portion of each cartridge P. On the inner side of the transfer belt 12, there are provided four primary transfer rollers 16 respectively opposite the drums 4 of the cartridges P.

Further, a secondary transfer roller 17 is arranged so as to be in press-contact with the secondary transfer opposing roller 14 across the transfer belt 12. The contact portion between the transfer belt 12 and the secondary transfer roller 17 constitutes a secondary transfer portion.

A feeding unit 18 is provided below the unit 11. This feeding unit 18 has a sheet feeding tray 19 for storing recording mediums S stacked together, and a sheet feeding roller 20.

On the apparatus rear surface side in the apparatus main body 2, there is arranged a higher recording medium conveyance route 21 extending from the sheet feeding roller 20 below to a recording medium discharge port portion 25 above. A registration unit 22, a secondary transfer roller 17, a fixing unit 23, and a discharge unit 24 are arranged in that order from the lower side to the upper side along the recording medium conveyance route 21. The upper surface of the apparatus main body 2 constitutes a discharge tray 26.

[Image Forming Operation]

The operation of forming a full-color image is described as follows: The respective drums 4 of the first through fourth cartridges are driven and rotated at a predetermined speed (counterclockwise as indicated by the arrow J in FIGS. 2 and 4A). The transfer belt 12 is also driven and rotated in a forward direction relative to the counterclockwise rotation of the drums 4 as indicted by the arrow T in FIGS. 2 and 4A at a speed corresponding to the speed of the drums 4.

The laser scanner unit LB is also driven. In synchronism with the driving of the unit LB, the surfaces of the drums 4 are uniformly charged by charging rollers 5 to have a predetermined polarity and potential. The charging rollers 5 are driven and rotated along with the rotation of the drums 4. The unit LB performs scanning exposure of the surfaces of the drums 4 with the laser beam N in correspondence with image signals of the different colors.

As a result, electrostatic latent images corresponding to the image signals of the corresponding colors are formed respectively on the surfaces of the drums 4. These electrostatic latent images are developed by developing rollers 6 configured to be rotated at a predetermined speed (clockwise as indicated by the arrow E of FIG. 4A).

Through the above electrophotographic image forming process, a yellow developer image corresponding to the yellow component of the full-color image is formed on the drum 4 of the first cartridge PY. And, the developer image is primarily transferred onto the transfer belt 12.

Similarly, a magenta developer image corresponding to the magenta component of the full-color image is formed on the drum 4 of the second cartridge PM. And, the developer image is primarily transferred onto the transfer belt 12 to be superimposed on the yellow developer image already transferred thereto.

Similarly, a cyan developer image corresponding to the cyan component of the full-color image is formed on the drum 4 of the third cartridge PC. And, the developer image is primarily transferred onto the transfer belt 12 to be superimposed on the yellow and magenta developer images already transferred thereto.

Similarly, a black developer image corresponding to the black component of the full-color image is formed on the drum 4 of the fourth cartridge PK. And, the developer image is primarily transferred onto the transfer belt 12 to be superimposed on the yellow, magenta, and cyan developer images already transferred thereto.

In this way, a four full-color unfixed developer image of yellow, magenta, cyan, and black colors is formed on the transfer belt 12 which have successively passed the primary transfer portions of the first through fourth cartridges P (PY, PM, PC, and PK).

On the other hand, recording mediums S are fed from the feeding unit 18 with predetermined control timing and separately one by one. Each recording medium S is upwardly conveyed through the recording medium conveyance route, and is introduced with predetermined control timing into the secondary transfer portion, which is the contact portion between the secondary transfer roller 17 and the transfer belt 12. As a result, as the nipped recording medium S is conveyed through the secondary transfer portion, the superimposed four-color developer images on the transfer belt 12 are successively and collectively transferred to the surface of the recording medium S.

The recording medium S having left the secondary transfer portion is separated from the transfer belt 12 to be introduced into a fixing unit 23, and the unfixed developer image is fixed by a fixing unit to become a fixed image. The recording medium S having left the fixing unit is sent out onto the discharge tray 26 outside the apparatus by a discharge unit 24 through a discharge opening 25.

[Cartridge Replacing Method]

In the image forming apparatus 1 according to the present exemplary embodiment, each cartridge P is replaced in an front access manner using a method by which the cartridge P is placed on a cartridge tray (drawing-out member; moving member configured to move while supporting the cartridge) 60 which can be drawn out from the apparatus body 2.

Figure 3:
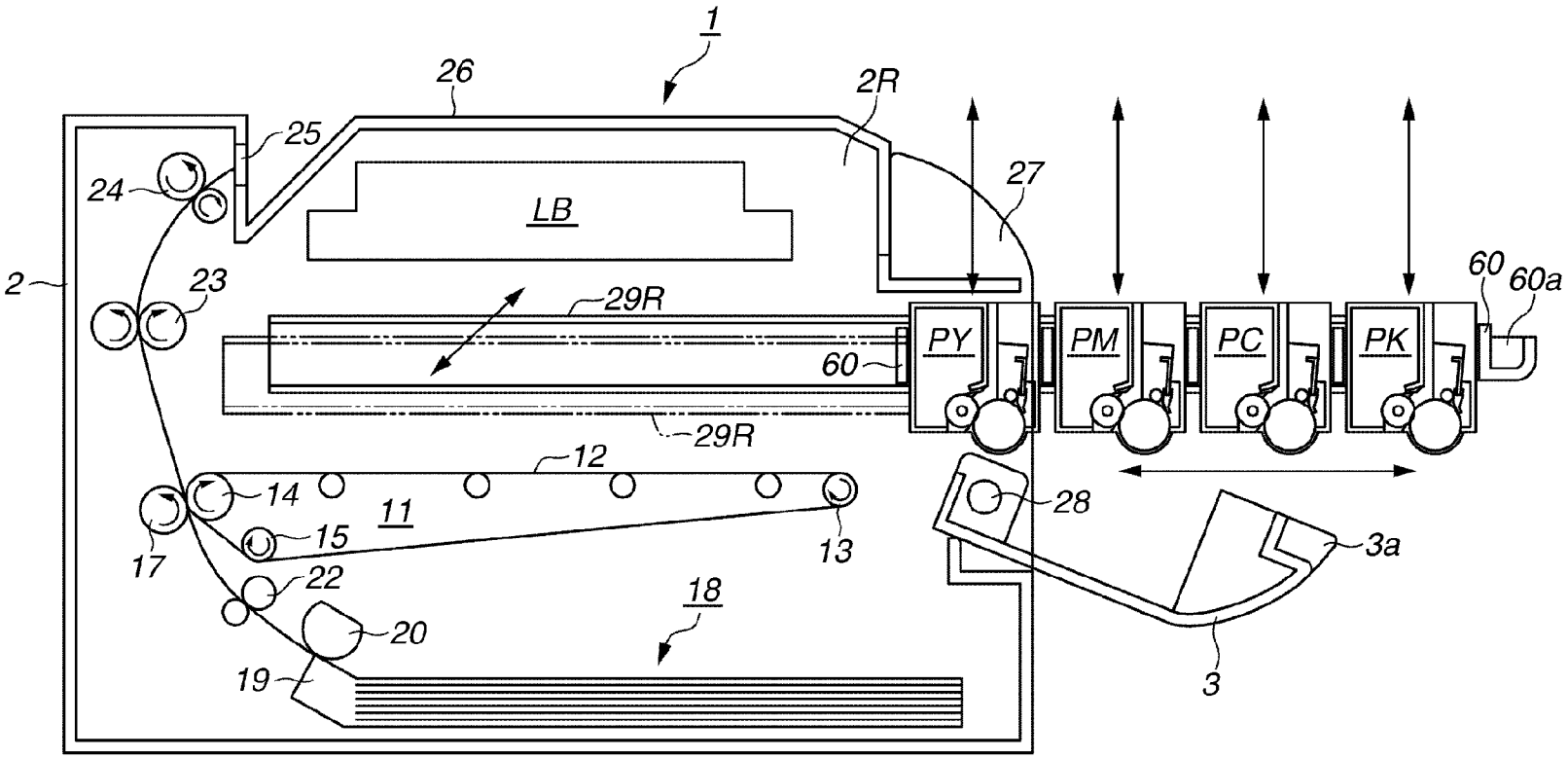
FIG. 3 is a sectional view of the image forming apparatus with a cartridge tray thereof drawn out.

An opening 27 is provided on the front side of the apparatus main body 2. Further, there is provided a front door 3 for opening and closing the opening 27. The door 3 is rotatable in opening and closing the apparatus main body 2 around a lateral shaft (hinge shaft) 28 at the door lower side. The door 3 is rotated in an erecting direction around the hinge shaft 28, and can be closed in the apparatus main body 2 as illustrated in FIG. 2. Further, the door 3 is rotated around the hinge shaft 28 to fall on the front side of the apparatus main body 2, and can place the opening 27 in a greatly opened state as illustrated in FIG. 3. Reference numeral 3*a* indicates a handle portion provided on the door 3.

On the inner side of a left frame 2L (not illustrated) of a main frame constituting the framework of the apparatus main body 2 and on the inner side of a right frame 2R of the same, there are arranged a pair of left and right tray retaining members 29L (not illustrated) and 29R extending in a direction from the front surface of the image forming apparatus to the rear surface of the image forming apparatus so as to be opposite to each other. Between the retaining members 29L and 29R, the cartridge tray 60 is held and can horizontally slide in either front-to-back or back-to-front directions. Each cartridge P is supported by this tray 60.

The door 3 and the retaining members (29L) and 29R are connected to each other via a door link (not illustrated). In conjunction with the opening rotation of the door 3, the retaining members (29L) and 29R are pulled by the door link to move forwards and upwards, i.e., obliquely, by a predetermined amount along a guide member (not illustrated) within the apparatus main body 2.

In conjunction with the forward movement of the retaining members (29L) and 29R, the connection of a drive output portion (not illustrated) on the apparatus main body side with a drive input portion (not illustrated) of each cartridge P is cancelled. Further, the pressing of each cartridge P by a pressure mechanism (not illustrated) which fixes a position of each cartridge P is cancelled. Further, the fixing of a position of the tray 60 is cancelled. Power distribution from a power supply system (not illustrated) to an input electrical contact (not illustrated) on each cartridge P side is cancelled.

As a result of the oblique upward movement of the tray 60 supporting each cartridge P, together with the retaining members (29L) and 29R, each cartridge P is raised from a positioning portion (not illustrated). As a result, the lower surface of the drum 4 of each cartridge P is separated from the surface of the belt 12 to be placed in a non-contact state, and the tray 60 can be drawn out of the apparatus main body 2.

Then, the user grasps the handle portion 60*a* exposed through the opening 27, and causes the tray 60 to slide forward from within the apparatus main body 2 in a direction horizontal to the retaining members (29L) and 29R. Then, as illustrated in FIG. 3, the tray 60 is drawn out to a sufficient degree to a predetermined drawn-out position outside the apparatus main body 2 from the opening 27. As a result, a whole of cartridges P retained by the tray 60 passes the opening 27 to be exposed to the exterior of the apparatus main body 2, and the top surfaces of all the cartridges P are accessible.

When drawn out by a predetermined sufficient amount, the tray 60 is prevented from making further a draw-out movement by a stopper portion (not illustrated). Further, the tray 60 is stably maintained by the retaining members (29L) and 29R being horizontally drawn out to a predetermined drawn-out position. Due to this construction, it is possible to replace the cartridge P through front access without having to move the belt 12.

The tray 60 supports each cartridge P so as to allow its extraction from directly above. The tray 60 supports each cartridge P by moving it to directly below. Thus, the used-up cartridge P to be replaced is raised from the tray 60 and extracted. Then, a new cartridge P is placed on the tray 60 by fitting from above.

After the replacement of the old cartridge P with a new one in the tray 60, the tray 60 having been drawn out slides backwardly and horizontally relative to the retaining members (29L) and 29R, and is pushed into the inner side of the apparatus main body 2 via the opening 27. This pushing-in is sufficiently performed until further pushing-in of the tray 60 is inhibited by a stopper portion (not illustrated).

Then, the door 3 is rotated to close. In conjunction with this rotation for closing of the door 3, the retaining members (29L) and 29R are pressed by the door link, and are moved within the apparatus main body 2 backwards and downwards along the guide member, i.e., returned by a predetermined amount obliquely downwards.

In conjunction with the returning movement of the retaining members (29L) and 29R, the cartridge pressing mechanism performs pressing operation, whereby each cartridge P is fixed at a positioning portion on the apparatus main body 2 side. Further, the drive output portion on the apparatus main body 2 side is connected with the drive input portion of each cartridge P. Further, the power supply system on the apparatus main body side is brought into conduction to the input electrical contact on each cartridge P side. Further, the tray 60 is fixed in its position. The lower surface of the drum 4 of each cartridge P is brought into contact with the surface of the belt 12.

That is, the state of FIGS. 2 and 4A, in which each cartridge P is attached to the latent image forming position within the apparatus main body 2, is restored, making it possible to perform the image forming operation.

[Overall Construction of the Process Cartridge]

As described above, in the present exemplary embodiment, the first through fourth cartridges P (PY, PM, PC, and PK) have the same electrophotographic image forming process mechanism, and they differ from each other in the color and amount of the developer stored therein. As illustrated in FIG. 4A, the cartridge P is equipped with the drum 4 and the process units acting on the drum 4. The process unit includes the charging roller 5 as the charging unit for charging the drum 4, the developing roller 6 as the developing unit for developing the latent image formed on the drum 4, the cleaning blade 7 as the cleaning unit for removing residual developer from the surface of the drum 4, etc.

And, the cartridge P is divided into the drum unit 8 and the developing unit 9, which are swingably connected with each other.

[Construction of the Drum Unit]

Figure 5A:
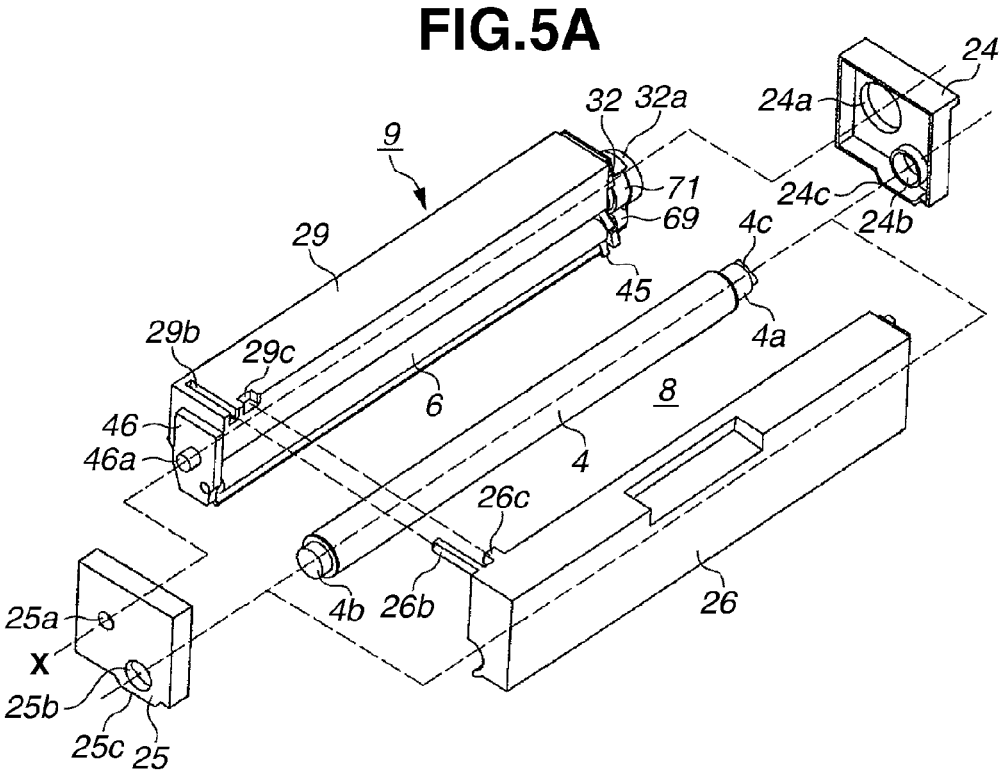
FIGS. 5A through 5C are explanatory views illustrating the construction of the process cartridge.
Figure 5B:
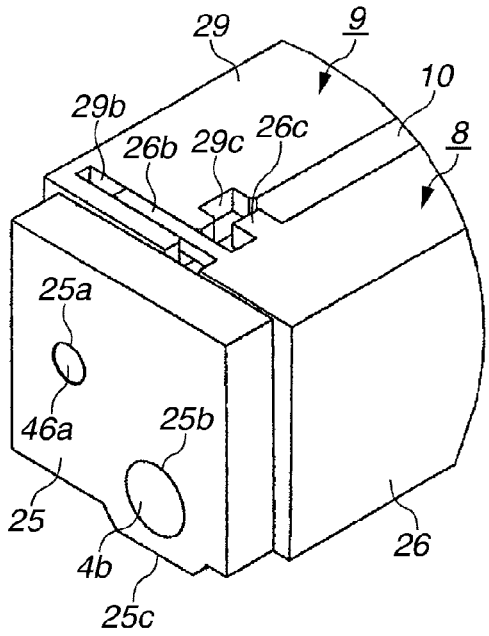
Figure 5C:
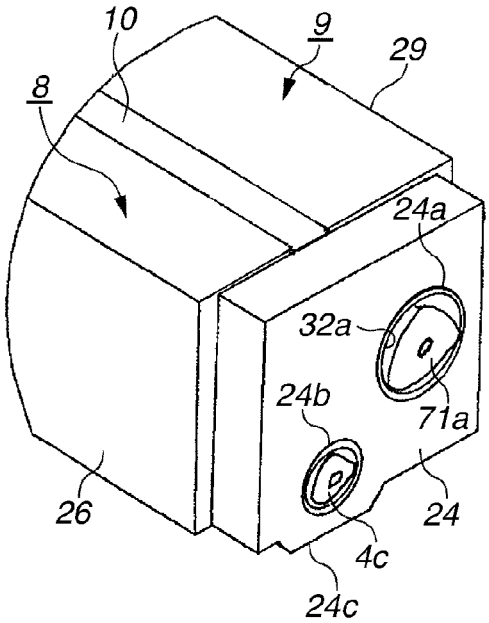

FIG. 5A is an exploded perspective view of the cartridge P, FIG. 5B is a perspective view of a non-driving side end of the cartridge P, and FIG. 5C is a perspective view of the driving side end of the cartridge P.

The axial direction of the drum 4 will be defined as the longitudinal direction. Thus, the longitudinal direction with respect to the cartridge P and the cartridge forming member, is a direction parallel to the axial direction of the drum 4. Further, the longitudinal direction is also a direction substantially parallel to the axial direction of the developing roller.

As illustrated in FIGS. 4A and 5A, the drum unit 8 is formed by the drum 4, the charging roller 5, the cleaning blade 7, a cleaning frame member (first frame member) 26 having a waste toner storage portion 26*a*, and cartridge cover members 24 and 25. Numeral 24 denotes a driving side cartridge cover member (hereinafter referred to as the driving side cover member), and numeral 25 denotes a non-driving side cartridge cover member (hereinafter referred to as the non-driving side cover member).

The driving side cover member 24 is a plate-like member of a size and configuration suitable for covering the driving side end surface (one of end sides in the longitudinal direction) of both the cleaning frame member 26 of the drum unit 8 and the developing frame member 29 of the developing unit 9.

The driving side cover member 24 and the non-driving side cover member 25 are respectively mounted to the driving side end surface and the non-driving side end surface of the cleaning frame member 26 so as to be fixed thereto in a predetermined fashion. The drum 4 is arranged between the driving side cover member 24 and the non-driving side cover member 25 being rotatably supported. That is, a driving side shaft portion 4*a* and a non-driving side shaft portion 4*b* of the drum 4 are respectively fit-engaged with a support hole 24*b* provided in the driving side cover member 24, and a support hole 25*b* provided in the non-driving side member 25 being thereby rotatably supported.

As illustrated in FIGS. 5A and 5C, at an end of the driving side shaft portion 4*a* of the drum 4, a coupling member (drive input portion) 4*c* for transmitting drive force to the drum 4 is provided. The coupling member 4*c* is exposed to the outer side through the support hole 24*b* of the driving side cover member 24. In the state in which the cartridge P is attached to the apparatus main body 2, a coupling member (not illustrated) as the drive output portion on the apparatus main body side is connected with the coupling member 4*c*. Thus, the drive force of the drive motor (not illustrated) of the apparatus main body is transmitted to rotate the drum 4.

The charging roller 5 is supported by the cleaning frame member 26 to be driven to rotate while in contact with the drum 4. The cleaning blade 7 is supported by the cleaning frame member 26 to be in counter contact with the peripheral surface of the drum 4 with a predetermined pressure. The residual developer after transfer which is removed from the peripheral surface of the drum by the cleaning blade 7 is stored in the waste toner storage 26*a* in the cleaning frame member 26.

Further, the driving side cover member 24 and the non-driving side cover member 25 are respectively provided with support holes 24*a* and 25*a* for rotatably (swingably) supporting the developing unit 9. Further, the portion of the driving side cover member 24 below the support hole 24*b* and the portion of the non-driving side cover member 25 below the support hole 25*b* respectively constitute portions 24*c* and 25*c* to be positioned relative to the positioning portions on the apparatus main body side when the cartridge P is attached to the apparatus main body 2.

Further, the cleaning frame member 26 is provided with a first regulating portion 26*b* and a second regulating portion 26*c* of a convex configuration.

[Construction of the Developing Unit]

As illustrated in FIGS. 4A and 5A, the developing unit includes the developing roller 6, the developing blade 31, the developing frame member (second frame member) 29, bearing members 45 and 46, a developing cover member 32, etc.

The developing frame member 29 has a toner storage portion 29*a* for storing developer t to be supplied to the developing roller 6, the developing blade 31 configured to regulate the thickness of the layer of developer on the peripheral surface of the developing roller, and a scooping sheet (flexible elastic sheet) 33 configured to prevent leakage of the developer t.

Further, as illustrated in FIG. 5A, the driving side bearing member 45 is fixed to the driving side (one end in the longitudinal direction) of the developing frame member 29. Further, the non-driving side bearing member 46 is fixed to the non-driving side (the other end in the longitudinal direction) of the developing frame member 29. The driving side bearing member 45 and the non-driving side bearing member 46 rotatably support the developing roller 6. The developing roller 6 has a developing roller gear 69. The driving side bearing member 45 also rotatably supports an input gear 71 for transmitting drive force to the developing roller gear 69.

And, in the longitudinal direction of the cartridge P, the developing cover member 32 is fixed to the outer side of the driving side bearing member 45. This developing cover member 32 is configured to cover the developing roller gear 69 and the input gear 71.

Further, the developing frame member 29 is provided with first regulated portion 29*b* and a second regulated portion 29*c* of a concave configuration.

[Assembly of the Drum Unit and the Developing Unit]

As illustrated in FIG. 5A, when assembling the developing unit 9 and the drum unit 8, on the driving side, a cylindrical portion 32*a* of the developing cover member 32 is fit-engaged with a support hole 24*a* of a driving side cover member 24. On the non-driving side, a protrusion (shaft portion) 46*a* provided to protrude to the non-driving side bearing member 46 is fit-engaged with a support hole 25*a* of a non-driving side cover member 25. As a result, the developing unit 9 is rotatably supported relative to the drum unit 8.

At an end surface of the developing input gear 71, there is coaxially provided a coupling member (drive input portion) 71*a* (FIG. 5C) for transmitting drive force to the developing roller 6. The cylindrical portion 32*a* is provided coaxially relative to the coupling 71*a* so as to surround the same. As illustrated in FIG. 5C, the coupling member 71*a* is exposed to the exterior through the cylindrical portion 32*a* fit-engaged with the support hole 24*a* of the driving side cover member 24.

Thus, in the state in which the cartridge P has been attached to the apparatus main body 2, a coupling member (not illustrated) as the drive output portion on the apparatus main body side is connected with the above-mentioned coupling member 4*c*. As a result, the driving force of the drive motor (not illustrated) of the apparatus main body is transmitted, and the developing roller 6 is rotated via the input gear 71 and the developing roller gear 69.

The rotation center of the developing unit 9 relative to the drum unit 8 will be referred to as the rotation center X. This rotation center X is an axial line connecting the center of the support hole 24*a* and the center of the support hole 25*a*. Further, as illustrated in FIGS. 5A and 5B, the developing unit 9 and the drum unit 8 are assembled such that the position in the longitudinal direction of the first regulating portion 26*b* of the cleaning frame member 26 and that of the first regulated portion 29*b* of the developing frame member 29 coincide with each other. At this time, the position in the longitudinal direction of the second regulating portion 26*c* of the cleaning frame member 26 coincides with that of the second regulated portion 29*c* of the developing frame member 29.

[Contact of the Developing Roller and the Photosensitive Drum]

As illustrated in FIG. 4A, the developing unit 9 is urged by a pressure spring 95 which is an elastic member. Thus, the developing unit 9 is constructed such that the developing roller 6 comes into contact with the drum 4 around the rotation center X. That is, owing to the urging force of the pressure spring 95, the developing unit 9 is pressed in the direction of the arrow G in FIG. 4A, and, in FIG. 4A, a moment in the direction of the arrow H is exerted around the rotation center X. As a result, the developing roller 6 can be brought into contact with the drum 4 with a predetermined pressure. In this case, the position of the developing unit 9 in which the developing roller 6 and the drum 4 are held in contact with each other will be defined as the contact position of the developing unit 9.

[Separation of the Developing Roller and the Photosensitive Drum]

The developing roller 6 employs an elastic member formed of rubber or the like. When, from the production until the user starts to use the cartridge, the developing roller 6 and the drum 4 are held in contact with each other for a long period of time, the elastic member of the developing roller 6 undergoes deformation, and there is a fear that a defective image is generated. Further, during transportation, the surface of the developing roller 6 and the surface of the drum 4 may rub on each other to leave rubbing marks on the surface of the developing roller 6 and the surface of the drum 4, and there is a fear that a defective image is generated.

Figure 4B:
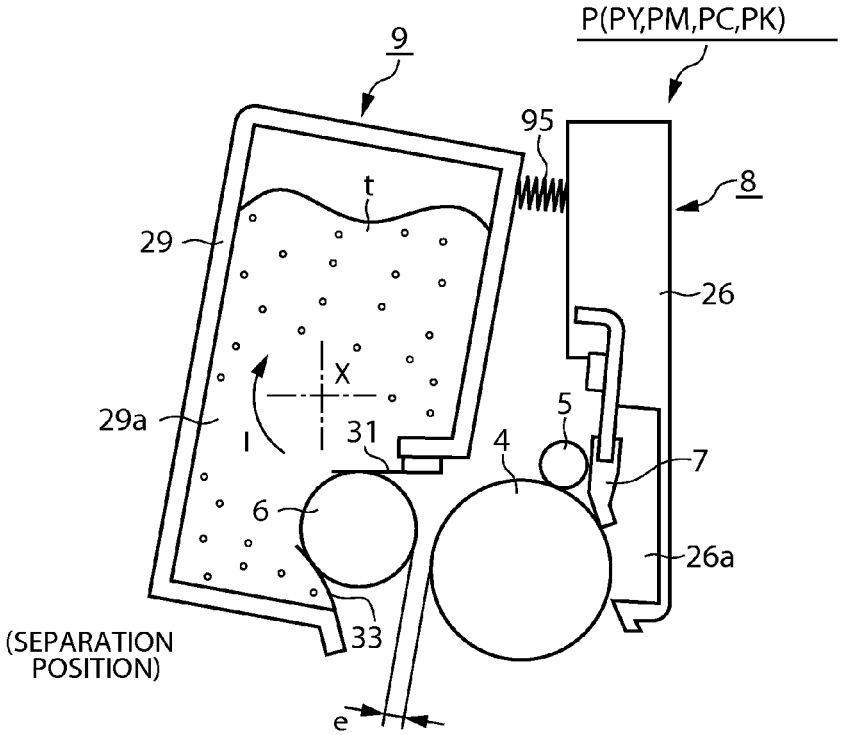

Thus, as illustrated in FIG. 4B, during transportation, the developing unit 9 is reversely urged within the cartridge P by the separation member (not illustrated) against the urging force of the pressure spring 95, and a separation distance e is maintained between the developing roller 6 and the drum 4. Further, when the cartridge P has been installed in the apparatus main body 2, and no image formation is being performed, the developing unit 9 is reversely urged against the urging force of the pressure spring 95 by a main body separation member (not illustrated) provided in the apparatus main body 2, and the separation distance e is maintained between the developing roller 6 and the drum 4.

That is, the developing unit 9 is regulated in the direction of the arrow I in FIG. 4B around the rotation center X by the separation member and the main body separation member. As a result, the developing roller 6 can be separated from the drum 4. The position of the developing unit 9 in which the developing roller 6 and the drum 4 are separated from each other will be defined as the separation position of the developing unit 9.

[Contact-Position/Separation-Position Regulating Portion]

Figure 1A:
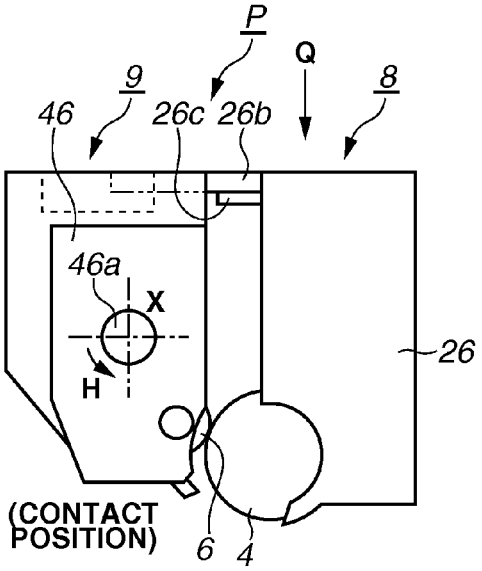
FIGS. 1A through 1D are explanatory views illustrating a contact position and a separation position of a developing unit in a process cartridge according to a first exemplary embodiment.
Figure 1B:
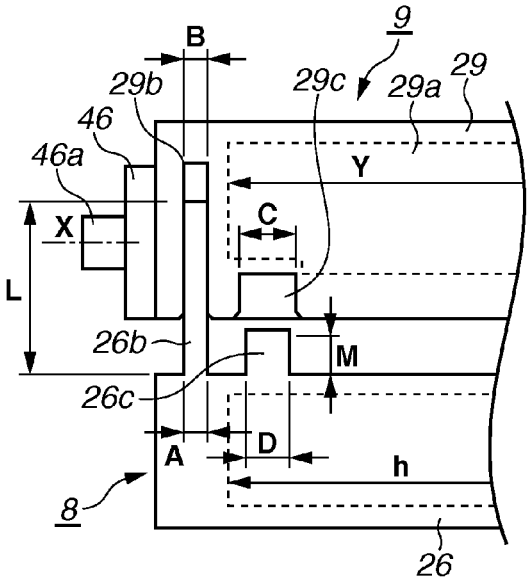

FIG. 1A is a side view as seen from the non-driving side of the cartridge P when the developing unit 9 is situated at the contact position. FIG. 1B is a top view of the non-driving side of the cartridge P as seen from the direction Q of FIG. 1A. For the sake of illustration, some of the components are not illustrated in FIGS. 1A and 1B.

When the cartridge P is attached to the apparatus main body 2, the drum unit 8 is fixed in a position at a positioning portion on the apparatus main body 2 side. As illustrated in FIG. 1A, the developing unit 9 is urged in the direction of the arrow H in FIG. 1A around the rotation center X, and is situated at the contact position where the developing roller 6 is held in contact with the drum 4. As illustrated in FIGS. 1A and 1B, at the contact position, the first regulating portion 26*b* of a convex configuration provided on the cleaning frame member 26 is engaged with the first regulated portion 29*b* of a concave configuration provided on the developing frame member 29.

The width A of the first regulating portion 26*b* and the width B of the first regulated portion 29*b* are fit-engaged with each other, and the position of the developing frame member 29 in the longitudinal direction is determined relative to the cleaning frame member 26 by the first regulating portion 26*b* and the first regulated portion 29*b*.

Figure 1C:
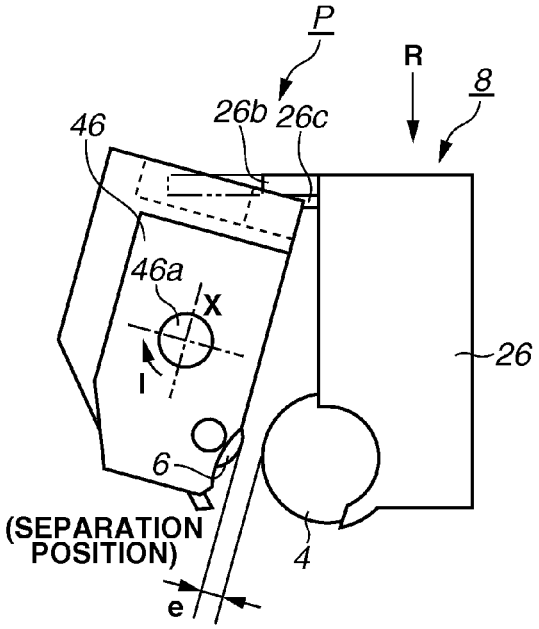
Figure 1D:
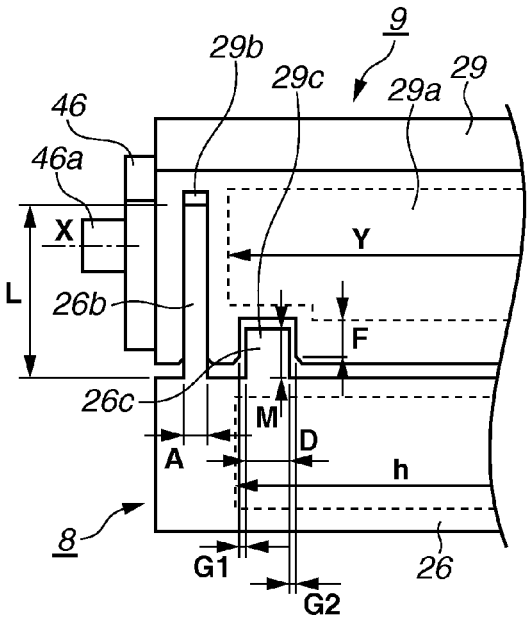

FIG. 1C is a side view, as seen from the non-driving side, of the cartridge P when the developing unit 9 is situated at the separation position. FIG. 1D is a top view, as seen from the R-direction of FIG. 1C, of the non-driving side of the cartridge P. For the sake of illustration, some of the components are not illustrated in FIGS. 1C and 1D.

As illustrated in FIG. 1C, the developing unit 9 is regulated in the direction of the arrow I in FIG. 1C around the rotation center X by a separation member (not illustrated), and is situated at the separation position where the developing roller 6 is separated from the drum 4. As illustrated in FIGS. 1C and 1D, at the separation position, the first regulating portion 26*b* of a convex configuration provided on the cleaning frame member 26 is fit-engaged (engaged) with the first regulated portion 29*b* of a concave configuration provided on the developing frame member 29. That is, the first regulating portion 26*b* and the first regulated portion 29*b* are engaged with each other both in the case where the developing unit 9 is at the contact position and in the case where it is at the separation position. Therefore, the developing unit 9 is regulated (hindered) in longitudinal movement independently of whether it is at the contact position or the separation position.

Further, the second regulating portion 26*c* of a convex configuration provided on the cleaning frame member 26 is situated inside the second regulated portion 29*c* of a concave configuration provided on the developing frame member 29, and they overlap each other vertically in the longitudinal direction (the drum axial direction) in the region F of FIG. 1D. The width D of the second regulating portion 26*c* is larger than the width A of the first regulating portion 26*b*, and the second regulating portion 26*c* has higher rigidity with respect to a longitudinal force than the first regulating portion 26*b*.

Figure 6:
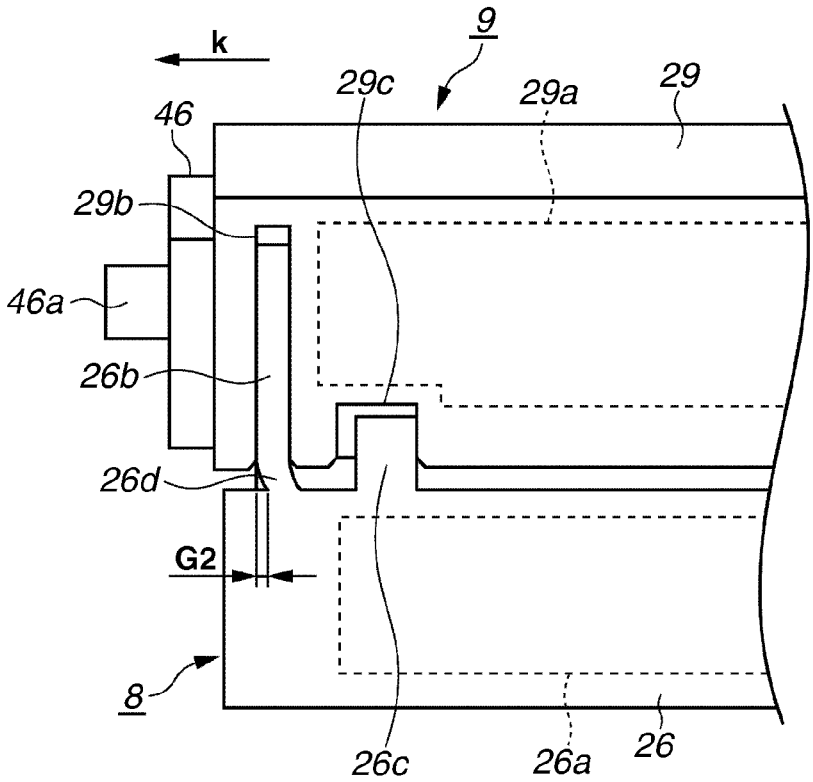
FIG. 6 is an explanatory view of a developing unit in a state in which a shock has been applied thereto.

As illustrated in FIG. 6, in the present construction, when the developing unit 9 is at the separation position, if a force is applied during transportation to the developing unit 9 in the direction of the arrow K in FIG. 6, a load is applied to the first regulating portion 26*b* which determines the longitudinal position of the developing unit 9, and the first regulating portion 26*b* undergoes deformation 26*d*. However, by bringing the second regulating portion 26*c* and the second regulated portion 29*c* into contact with each other, it is possible to suppress the deformation amount of the first regulating portion 26*b* to be G2, which is of the same amount as the gap G2 between the second regulating portion 26*c* and the second regulated portion 29*c* illustrated in FIG. 1D.

Thus, even when a strong shock is imparted to the cartridge P during transportation or the like, it is possible to receive the developing unit 9 at two portions: the first regulating portion 26*b* and the second regulating portion 26*c*. Thus, it is possible to relieve the load applied to the first regulating portion 26*b*, making it possible to prevent great deformation or damage of the first regulating portion 26*b*.

As illustrated in FIGS. 1B and 1D, the length M of the second regulating portion 26*c* is smaller than the length L of the first regulating portion 26*b*. As illustrated in FIG. 1B, when the developing unit 9 is situated at the contact position, the second regulating portion 26*c* is separated from the second regulated portion 29*c*, and the second regulating portion 26*c* and the second regulated portion 29*c* do not overlap each other in the longitudinal direction.

Further, when the developing unit 9 is situated at the separation position, it must receive the shock during transportation, so that, as illustrated in FIG. 1D, the second regulating portion 26*c* approaches the second regulated portion 29*c*, and the second regulating portion 26*c* and the second regulated portion 29*c* overlap each other in the longitudinal direction within the range F.

In this way, only when the developing unit 9 is situated at the separation position, the second regulating portion 26*c* is made short so that the second regulating portion 26*c* and the second regulated portion 29*c* may overlap each other in the longitudinal direction. This makes it possible to reduce the amount by which the second regulating portion 26*c* enters the developer storage 29*a* of the developing frame member 29.

At the separation position, the fit-engagement length of the second regulating portion 26*c* and the second regulated portion 29*c* (the length of the region where they are engaged with each other) is measured in the direction in which the second regulating portion 26*c* makes relative movement relative to the second regulated portion 29*c*, and the length thus measured will be referred to as the length M. Further, the fit-engagement length of the first regulating portion 26*b* and the first regulated portion 29*b* is measured in the direction in which the first regulating portion 26*b* makes relative movement relative to the second regulated portion 29*c*, and the length thus measured will be referred to as the length L. At this time, the fit-engagement length M of the second regulating portion 26*c* and the second regulated portion 29*c* is shorter than the fit-engagement length L of the first regulating portion 26*b* and the first regulated portion 29*b*.

That is, in the longitudinal direction, it is possible to arrange the second regulating portion 26*c* on the inner side of the first regulating portion 26*b* and in the same region Y as the developer storage 29*a* without reducing the volume of the toner t stored in the developer storage 29*a*.

In this way, in the present construction, the second regulating portion 26*c* is arranged on the inner side of the first regulating portion 26*b*, whereby it is possible to achieve a reduction in the size in the longitudinal direction of the cartridge P.

In the present exemplary embodiment described above, the second regulating portion 26*c* is of a convex configuration, and the second regulated portion 29*c* is of a concave configuration. However, in the case where the second regulating portion 26*c* is of a concave configuration and the second regulated portion 29*c* is of a convex configuration, it is possible to arrange the second regulating portion 26*c* in the same region h as the waste toner storage portion 26*a* of the cleaning frame member 26, whereby it is possible to reduce the size of the cartridge P in the longitudinal direction.

As illustrated in FIG. 1B, the difference between the width C of the second regulated portion 29C and the width D of the second regulating portion 26*c* is larger than the difference between the width B of the first regulated portion 29*b* and the width A of the first regulating portion 26*b*. That is, the gap between the first regulated portion 29*b* and the first regulating portion 26*b* is to be expressed as B−A, and the gap between the second regulated portion 29*c* and the second regulating portion 26*c* is to be expressed as C−D. These gaps are in the following relationship: B−A<C−D.

The first regulated portion 29*b* and the first regulating portion 26*b* are in a fit-engagement relationship, and B−A ranges from 0 to 100 μm.

The second regulated portion 29*c* and the second regulating portion 26*c* are in a gap fit-engagement relationship. Assuming that the gaps formed on one side of the second regulated portion 29*c* and the second regulating portion 26*c* are G1 and G2, C−D=G1+G2. The gap G1 and the gap G2 are gaps large enough to prevent breakage of the first regulating portion 26*b* (approximately 1.0 mm or less).

In this way, the gap C−D between the second regulated portion 29*c* and the second regulating portion 26*c* is set larger than the gap B−A between the first regulated portion 29*b* and the first regulating portion 26*b*. As a result, when the cartridge P is installed in the apparatus main body 2 even if image formation and intermission states are alternately repeated, and the developing unit 9 is repeatedly moved between the contact position and the separation position, it is possible to determine the position of the developing unit 9 in the longitudinal direction with high accuracy relative to the drum unit 8. That is, in the state in which the second regulating portion 26*c* and the second regulated portion 29*c* are not in contact with each other and in which solely the first regulating portion 26*b* and the first regulated portion 29*b* are fit-engaged with each other, it is possible to determine the position of the developing unit 9 in the longitudinal direction with high accuracy relative to the drum unit 8.

In the case in which the first regulating portion 26*b* and the first regulated portion 29*b* are fit-engaged with each other, and, at the same time, the second regulating portion 26*c* and the second regulated portion 29*c* are also fit-engaged with each other to perform longitudinal regulation at two positions, the following occurs: That is, if there is a deviation of the distance between the first regulating portion 26*b* and the second regulating portion 26*c*, from the distance between the first regulated portion 29*b* and the second regulated portion 29*c*, however small it may be, either of these cannot be fit-engaged, which makes it impossible to perform longitudinal regulation. In view of this, it becomes necessary, as in the present construction, for the first regulated portion 29*b* and the first regulating portion 26*b* to be in a fit-engagement relationship, and for the second regulated portion 29*c* and the second regulating portion 26*c* to be fit-engagement relationship with respect to gaps.

Next, a second exemplary embodiment will be described with reference to FIGS. 7A-7D. The basic apparatus construction of the present exemplary embodiment is the same as that of the first exemplary embodiment, so a redundant description of what is common to them will be left out. The members having the same function as those of the first exemplary embodiment described above will be indicated by the same reference numerals.

In the first exemplary embodiment described above, the developing unit 9 is rotatably supported relative to the drum unit 8 by the driving side cover member 24 and the non-driving side cover member 25. In the second exemplary embodiment, a developing unit 109 is supported by a driving side cover member 124 (not illustrated) and a non-driving side cover member 125 (not illustrated) so as to be slidable relative to a drum unit 108 in a direction perpendicular to the longitudinal direction.

Figure 7A:
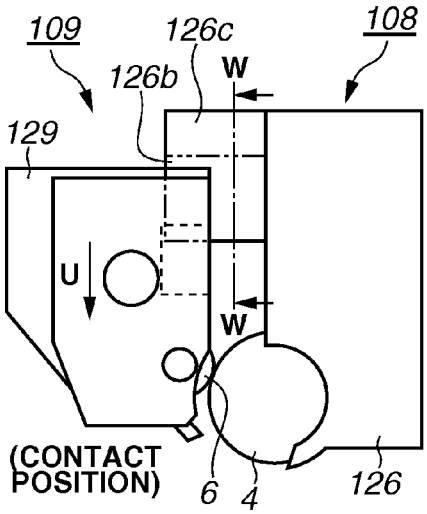
FIGS. 7A through 7D are explanatory views illustrating a separation position and a contact position in the developing unit in a process cartridge according to a second exemplary embodiment.
Figure 7B:
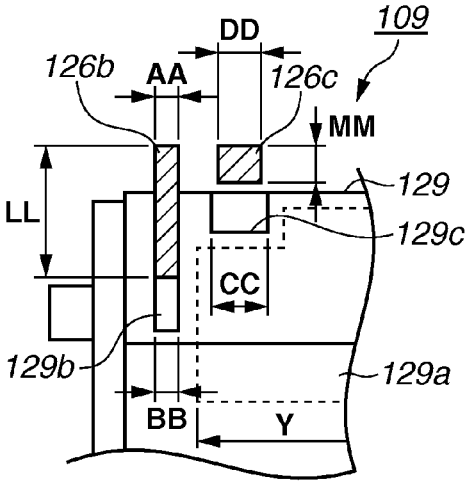
Figure 7C:
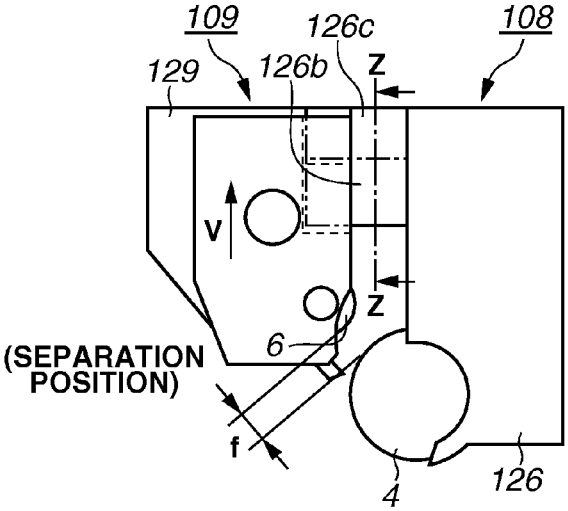

Referring to FIGS. 7A-7D, a construction will be described by way of an example in which the developing unit 109 is slidable in the vertical direction (downward direction: direction U in FIG. 7A; upward direction: direction V in FIG. 7C). However, the direction in which developing unit 109 is slidable is not restricted to the above-mentioned one.

FIG. 7A is a side view, as seen from the non-driving side, of the cartridge P when the developing unit 109 according to the second exemplary embodiment is situated at the contact position. For the sake of illustration, some of the components are not depicted.

As illustrated in FIG. 7A, when the developing unit 109 is at the contact position, the developing unit 109 is urged in the direction U in FIG. 7A by a pressure spring 195 (not illustrated), and the developing roller 6 is situated at the contact position, where it is held in contact with the drum 4. FIG. 7B is a sectional view as seen in the direction W of FIG. 7A. As illustrated in FIG. 7B, at the contact position, the first regulating portion 126*b* of a convex configuration provided on the cleaning frame member 126 is engaged with the first regulated portion 129*b* of a concave configuration provided on the developing frame member 129.

The width AA of the first regulating portion 126*b* and the width BB of the first regulated portion 129*b* are in a fit-engagement relationship, and the position in the longitudinal direction of the developing frame member 129 is determined relative to the cleaning frame member 126 by the first regulating portion 126*b* and the first regulated portion 129*b*. As illustrated in FIG. 7C, at the separation position of the developing unit 109, the developing unit 109 is urged by a separation member (not illustrated) in the direction V in FIG. 7C, and the developing roller 6 is situated at the separation position where it is separated from the photosensitive drum with a gap f.

Figure 7D:
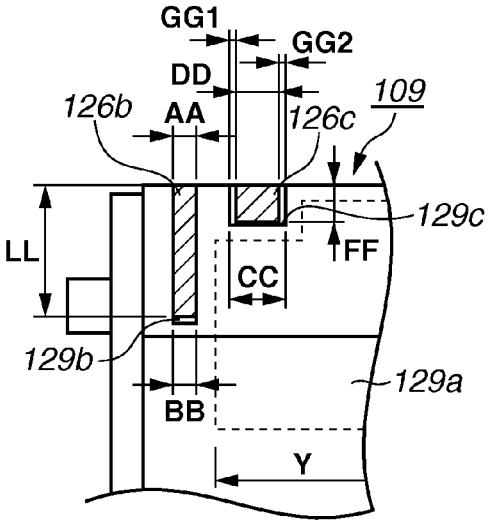

FIG. 7D is a sectional view in the direction Z of FIG. 7C. As illustrated in FIG. 7D, at the separation position, the first regulating portion 126*b* of a convex configuration provided on the cleaning frame member 126 is fit-engaged with the first regulated portion 129*b* of a concave configuration provided on the developing frame member 129.

Further, the second regulating portion 126*c* of a convex configuration provided on the cleaning frame member 126 is situated within the second regulated portion 129*c* of a concave configuration provided on the developing frame member 129. In the region FF of FIG. 7D, they overlap each other in a direction perpendicular to the longitudinal direction (the axial direction of the photosensitive drum).

As in the first exemplary embodiment, the width DD of the second regulating portion 126*c* is larger than the width AA of the first regulating portion 126*b*, and the second regulating portion 126*c* has higher rigidity with respect to a force in the longitudinal direction than the first regulating portion 126*b*.

Thus, as in the first exemplary embodiment, when a strong shock is imparted to the cartridge P during transportation or the like, the longitudinal direction of the developing unit 109 is regulated at the two portions of the first regulating portion 126*b* and the second regulating portion 126*c*. As a result, it is possible to prevent great deformation or damage of the first regulating portion 126*b*.

As illustrated in FIGS. 7B and 7D, the length MM of the second regulating portion 126*c* is shorter than the length LL of the first regulating portion 126*b*. As in the first exemplary embodiment, while the volume of toner t stored in the developing storage portion 129*a* is not reduced, and, in the longitudinal direction, it is possible to arrange the second regulating portion 126*c* on the inner side of the first regulating portion 126*b* and in the same region Y as the developer storage 129*a*. In the present construction, the second regulating portion 126*c* is thus arranged on the inner side of the first regulating portion 126*b*, whereby it is possible to reduce the size of the cartridge P in the longitudinal direction.

As illustrated in FIG. 7B, the difference between the width CC of the second regulated portion 129*c* and the width DD of the second regulating portion 126*c* is larger than the difference between the width BB of the first regulated portion 129*b* and the width AA of the first regulating portion 126*b*. That is, the gap between the first regulated portion 129*b* and the first regulating portion 126*b* is expressed as: BB−AA, and the gap between the second regulated portion 129*c* and the second regulating portion 126*c* is expressed as: CC−DD. They are in the relationship: BB−AA<CC−DD.

The first regulated portion 129*b* and the first regulating portion 126*b* are in a fit-engagement relationship, and BB−AA ranges from 0 to 100 μm.

Further, the second regulated portion 129*c* and the second regulating portion 126*c* are in a fit-engagement relationship with respect to gaps. When the gaps on one side of the second regulated portion 129*c* and the second regulating portion 126*c* are a gap GG1 and a gap GG2, CC−DD=GG1+GG2. The gap GG1 and the gap GG2 are gaps large enough to prevent breakage of the first regulating portion 126*b* (approximately 1.0 mm or less).

Thus, it is possible to attain the same effect as that of the first exemplary embodiment. That is, when the cartridge P is installed in the apparatus main body 2, even if image formation and operation intermission state are alternately repeated, and the developing unit 109 is repeatedly moved between the contact position and the separation position, it is possible to determine with high accuracy the position of the developing unit 109 in the longitudinal direction relative to the drum unit 108. That is, the second regulating portion 126*c* and the second regulated portion 129*c* are not held in contact with each other, and the first regulating portion 126*b* and the first regulated portion 129*b* are in a fit-engagement relationship, whereby it is possible to determine the position of the developing unit 109 in the longitudinal direction with high accuracy relative to the drum unit 108.

Finally, the construction and effect of the first and second exemplary embodiment may be summarized as follows: In the above-described exemplary embodiment, there is provided a second regulated portion configured to perform longitudinal regulation on the photosensitive drum and the developing unit and to receive a load, solely during transportation. As a result, it is possible to provide a small process cartridge capable of maintaining with high accuracy the position of the developing unit relative to the photosensitive drum unit.

The following will be another exemplary embodiment for maintaining with high accuracy the position of the developing unit in the longitudinal direction relative to the photosensitive drum unit. Before describing the construction of the present exemplary embodiment, the problem to be solved by the present exemplary embodiment will be first discussed with reference to FIG. 21. To determine the position of the developing unit in the photosensitive member axial direction relative to the photosensitive member unit (in order to regulate the movement of the developing unit in the photosensitive member axial direction), the photosensitive member unit may be provided with a regulating portion 926A as illustrated in FIG. 21. The regulating portion 926A is formed as a recess, and is engaged with a regulated portion 929A consisting of a protrusion provided on the developing unit.

However, when the position of the developing unit 9 relative to the photosensitive member unit 8 fluctuates, the position or orientation of the regulated portion 929A of the developing unit relative to the regulating portion 926A of the photosensitive unit 8 also fluctuates. As a result, the regulated portion 929A inclines, and a corner of the regulated portion 929A is engaged with the regulating portion 926A, so that it is possible that the regulated portion 929A and the regulating portion 926A are brought into contact with each other with high pressure (which may result in twist).

Here, when the developing unit 9 rotates relative to the photosensitive unit 8, the regulated portion 929A also makes a movement relative to the regulating portion 926A. In this process, when the pressure applied to the engagement region (contact region) between the regulating portion 926A and the regulated portion 929A increases, the resistance at the engagement region when the regulated portion 929A moves relative to the regulating portion 926A increases. As a result of the increase in resistance at the engagement region, the rotational operation of the developing unit 9 relative to the photosensitive unit 8 becomes unstable, and there is the possibility that the contact pressure of the developing roller relative to the photosensitive member also becomes unstable. Thus, conventionally, it has been necessary to enhance the strength of the regulating portion 926A and the regulated portion 929A.

Further, when the rotational operation of the developing unit 9 relative to the photosensitive unit 8 is repeated, while the regulating portion 926A and the regulated portion 929A are kept in contact with each other with high pressure, there is the possibility that the regulating portion 926A and the regulated portion 929A scrapes each other. As a result, there is the possibility that the position of the developing unit 9 relative to the photosensitive unit 8 fluctuates from a predetermined position in the axial direction of the photosensitive member (the axial direction of the developing roller).

In view of the above problem, the present exemplary embodiment aims at suppressing the movement of the developing unit (developing device) in the axial direction of the developer carrying member without hindering the rotational operation of the developing unit (developing device).

To that end, according to the present third exemplary embodiment, a curved surface is provided on the regulating portion provided in the photosensitive drum unit or on the regulated portion provided in the developing unit. This construction will be described in detail below.

[Construction of the Drum Unit]

Figure 9:
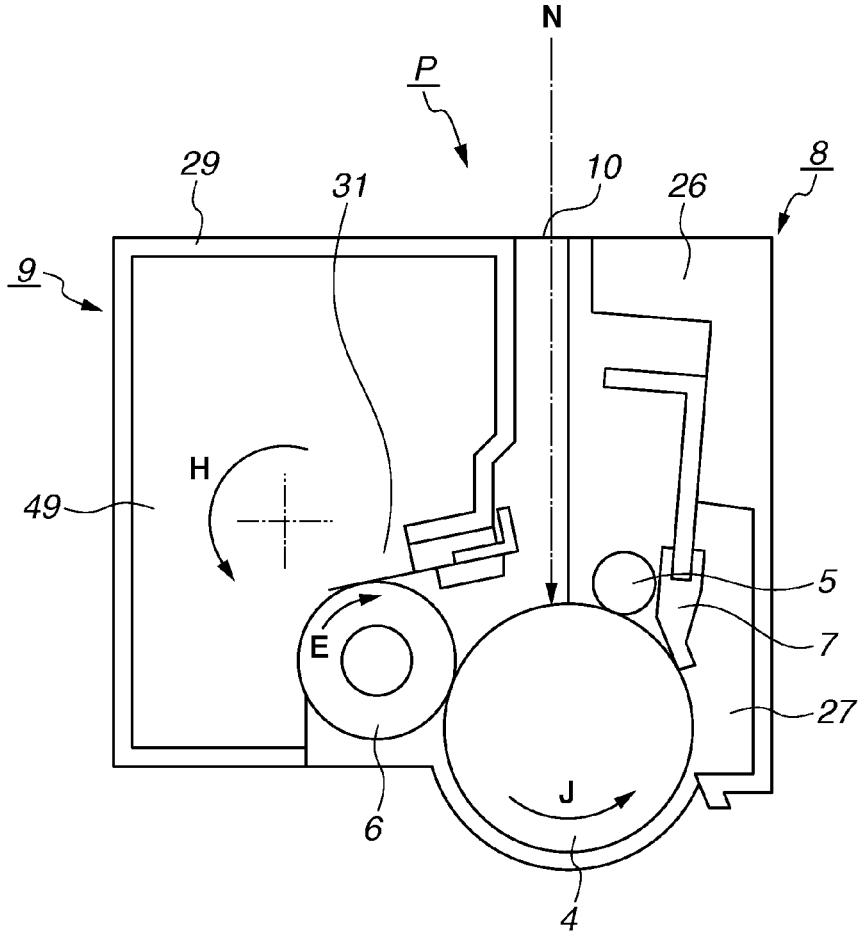
FIG. 9 is a sectional view of the process cartridge according to the third exemplary embodiment.
Figure 10:
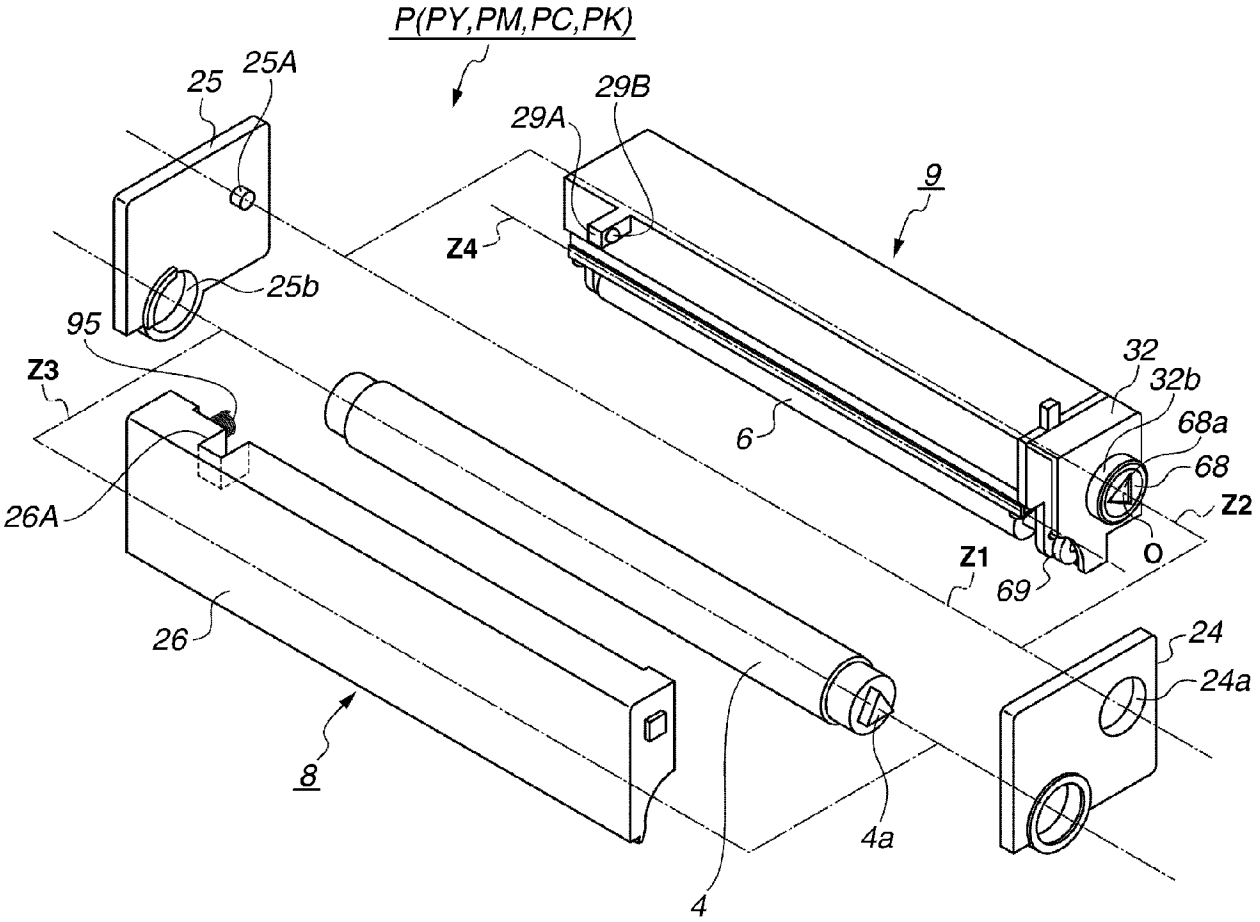
FIG. 10 is a perspective view of the process cartridge according to the third exemplary embodiment.
Figure 11:
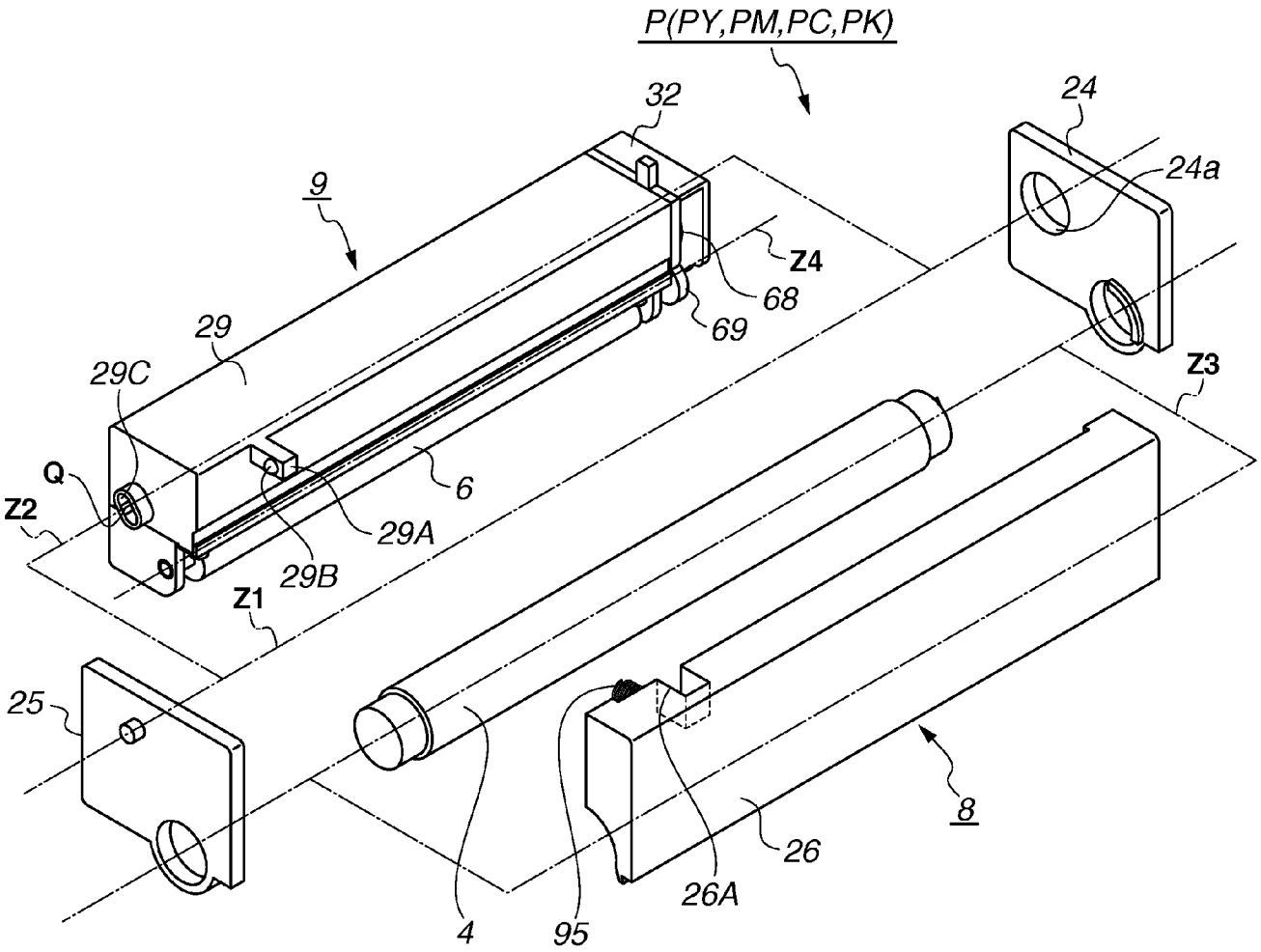
FIG. 11 is a perspective view of the process cartridge according to the third exemplary embodiment.

As illustrated in FIGS. 9, 10, and 11, the drum unit (photosensitive drum unit) 8 includes the drum 4, the charging roller 5, the cleaning blade 7, a cleaning container 26, the waste developer storage 27, and the cartridge cover. The cartridge cover includes the driving side cartridge cover 24 and the non-driving side cartridge cover 25 illustrated in FIG. 10.

The drum 4 is rotatably supported by the driving side cartridge cover 24 and the non-driving side cartridge cover 25 respectively provided at both longitudinal ends of the process cartridge P. The axial direction of the drum 4 will be defined as the longitudinal direction, and a direction perpendicular to the axial direction of the drum 4 will be defined as the lateral direction.

Further, the rotation axis (axis) of the drum 4 will be referred to as the drum axis Z3. The driving side cartridge cover 24 and the non-driving side cartridge cover 25 are fixed to the cleaning container 26 at both ends in the longitudinal direction of the cleaning container 26. Further, as illustrated in FIG. 10, at one end in the longitudinal direction of the drum 4, there is provided a coupling member 4*a* for transmitting drive force to the drum 4. The coupling member is engaged with a drum drive output portion of the image forming apparatus main body, and the drive force of a drive motor (not illustrated) of the image forming apparatus main body is transmitted to the drum 4. The charging roller 5 is supported by the cleaning container 26 so as to be driven to rotate while in contact with the drum 4. Further, the cleaning blade 7 is supported by the cleaning container 26 so as to be held in the peripheral surface of the drum 4 with a predetermined pressure. The transfer residual developer removed from the peripheral surface of the drum 4 by the cleaning blade 7 is stored in the waste developer storage 27 in the cleaning container 26. The driving side cartridge cover 24 is provided with a driving side support hole 24*a* as the driving side support portion (the other end side support portion), and the non-driving side cartridge cover 25 is provided with a protrusion 25*a* as the non-driving side support portion (one end support portion).

[Construction of the Developing Unit]

Figure 12:
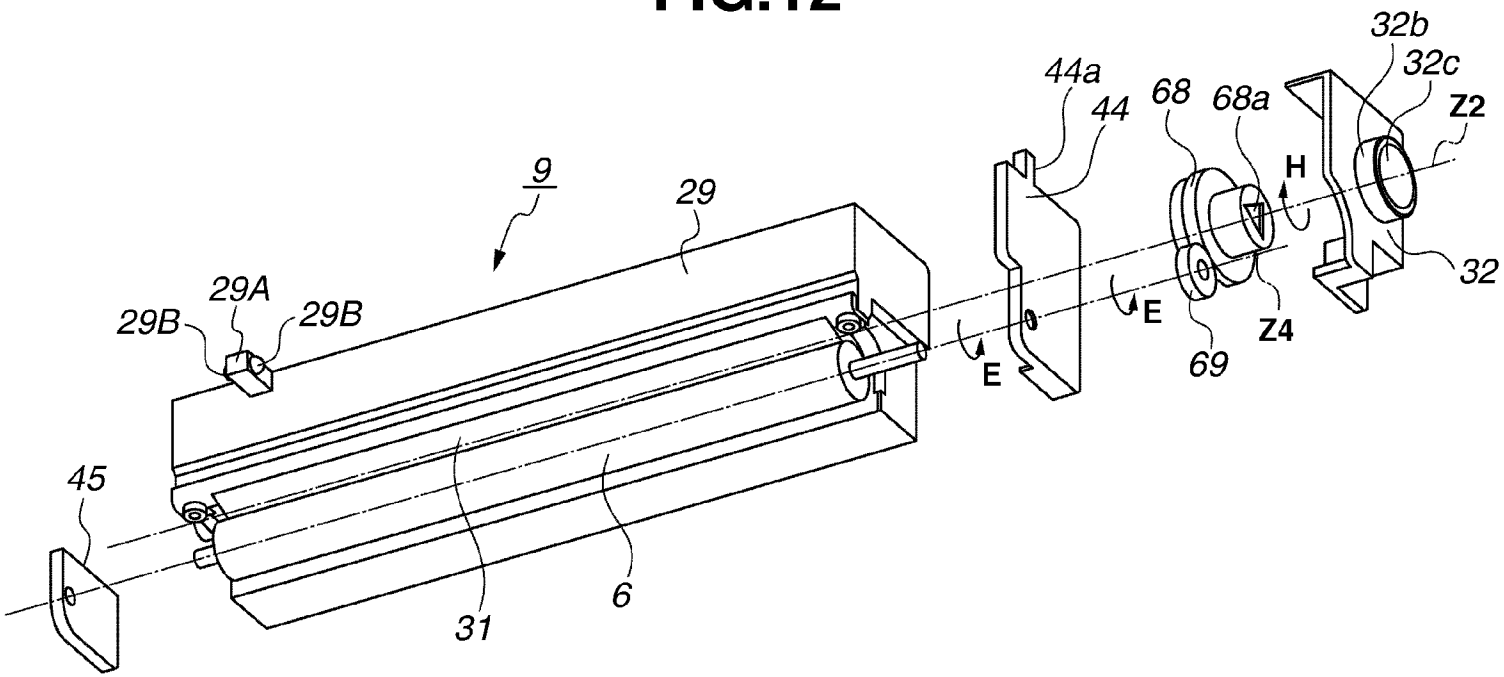
FIG. 12 is a perspective view of a developing unit according the third exemplary embodiment.

FIG. 12 illustrates the component construction of the developing unit.

As illustrated in FIGS. 9 and 12, the developing unit 9 includes the developing roller 6, a developing blade 31, the developing frame member 29, a driving side bearing 44, a non-driving side bearing 45, a developing cover member 32, etc. The developing frame member 29 has a developer storage 49 storing developer to be supplied to the developing roller 6, and the developing blade 31 configured to regulate the thickness of the developer layer on the peripheral surface of the developing roller 6. Further, as illustrated in FIG. 12, the driving side bearing 44 and the non-driving side bearing 45 are respectively fixed to both sides in the longitudinal direction of the developing frame member 29, rotatably supporting the developing roller 6. The rotation axis (axis) of the developing roller 6 will be referred to as the developing roller axis Z4. Further, the developing roller 6 has a developing roller gear 69 at the driving side end. Further, the driving side bearing 44 is provided with a developing drive input gear 68 configured to transmit drive force to the developing roller 6 via the developing roller gear 69. Further, the developing cover member 32 is fixed to the outer side in the longitudinal direction of the driving side bearing 44 so as to cover the developing roller gear 69 and the developing drive input gear 68.

Further, the developing cover member 32 is provided with a cylindrical portion 32*b* as supported portion on the driving side (the supported portion on the other end). Further, a drive transmission portion 68*a* of the developing drive input gear 68 is exposed from an opening 32*c* on the inner side of the cylindrical portion 32*b*. When the process cartridge P is attached to the image forming apparatus main body 2, the drive transmission portion 68*a* of the developing drive input gear 68 is engaged with a main body drive transmission member (not illustrated), and the drive force from the drive motor (not illustrated) provided in the image forming apparatus main body 2 is transmitted. The drive force input to the developing drive input gear 68 from the image forming apparatus main body 2 in the direction of the arrow H is transmitted so as to rotate the developing roller gear 69 and the developing roller 6 in the direction of the arrow E.

[Assembly of the Drum Unit and the Developing Unit]

As illustrated in FIGS. 10 and 11, when mounting the developing unit 9 and the drum unit 8, the outer portion of the cylindrical portion 32*b* of the developing cover member 32 is fit-engaged with the driving side support hole 24*a* of the driving side cartridge cover 24 on the driving side. On the non-driving side, the non-driving side support hole 29C as the supported portion on the non-driving side (supported portion on one end) provided in the developing frame member 29, is fit-engaged with the protrusion 25*a* of the non-driving side cartridge cover 25. Thus, the developing unit 9 is rotatably supported relative to the drum unit 8, and the developing unit 9 and the drum unit 8 are connected to each other.

The driving side support hole 24*a* and the cylindrical portion 32*b* are connection portions on the driving side connecting the developing unit 9 and the drum unit on the driving side of the process cartridge. The protrusion 25*a* and the non-driving side support hole 29C are connection portions on the non-driving side connecting the developing unit 9 and the drum unit 8 on the non-driving side of the process cartridge.

The axial line connecting the driving side support hole 24*a* of the driving side cartridge cover 24 and the protrusion 25*a* of the non-driving side cartridge cover 25 will be referred to as the developing unit support axis Z1. The axial line connecting the center O of the cylindrical portion 32*b* of the developing cover member 32 and the center Q of the non-driving side support hole 29C of the developing frame member 29 will be referred to as the developing unit axis Z2.

Further, to determine the position in the longitudinal direction of the developing unit 9 relative to the drum unit 8, the cleaning container 26 is provided with a regulating portion 26A. The regulating portion 26A is a recessed groove in the cleaning container 26. Further, the developing frame member 29 is provided with a regulated portion 29A, which is a protrusion protruding from the developing frame member 29. The regulated portion 29A enters the regulating portion 26A, whereby the regulating portion 26A and the regulated portion 29A are engaged with each other. Further, the regulated portion 29A has a semi-spherical curved surface 29B on the surface opposite the regulating portion 26A.

The regulating portion 26A is engaged with the curved surface 29B of the regulated portion 29A, whereby the position in the longitudinal direction of the developing unit 9 relative to the drum unit 8 is determined. That is, the regulating portion 26A and the regulated portion 29A regulate the movement of the developing unit 9 in the axial direction of the developing roller 6, thereby performing positioning of the developing unit 9.

[Description of the Contact Position and the Separation Position of the Developing Roller and the Drum]

Figure 13:
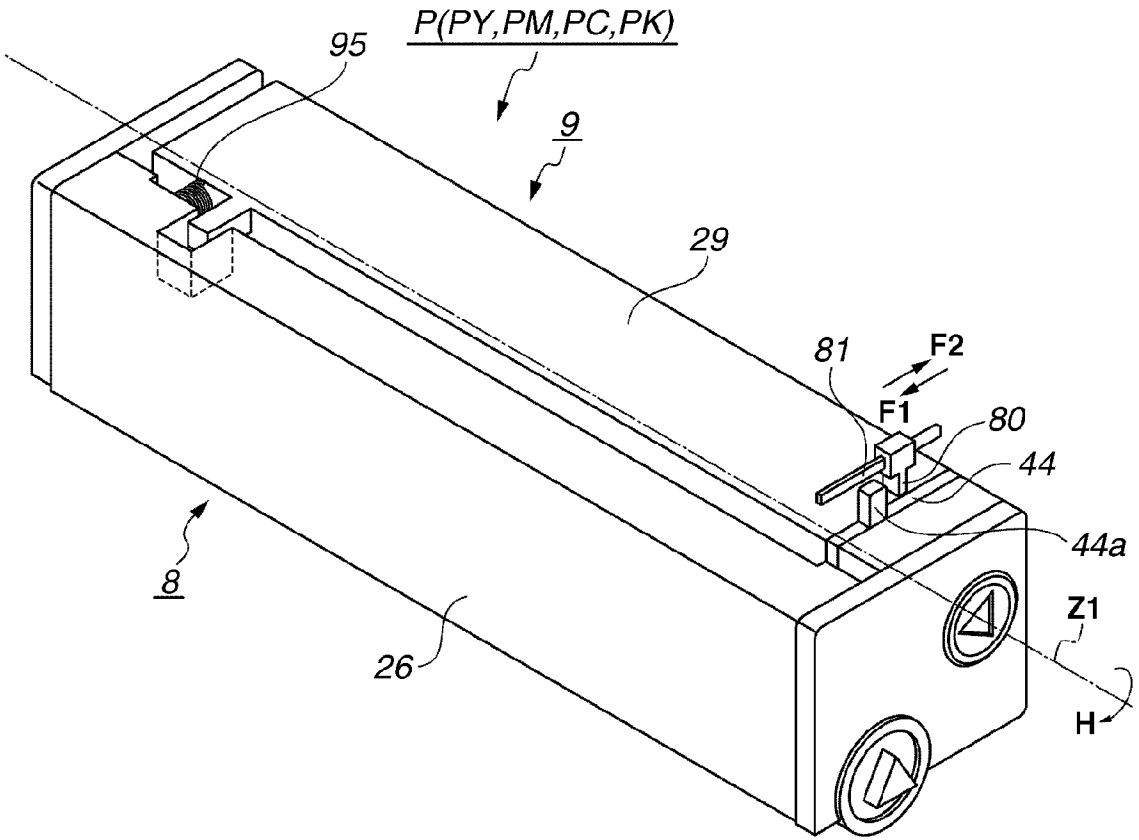
FIG. 13 is a perspective view of the process cartridge according to the third exemplary embodiment.

FIG. 13 is a perspective view as seen from the driving side of the process cartridge P. As illustrated in FIG. 13, the driving side bearing 44 is provided with a protrusion 44*a*. The protrusion 44*a* can be engaged with a main body separation member 80 provided in the image forming apparatus main body 2. The main body separation portion 80 receives drive force from a motor (not illustrated), and is movable in the directions of the arrow F1 and F2 along a rail 81. Further, the drum unit 8 is provided with a pressure spring 95 as an urging member.

Figure 8A:
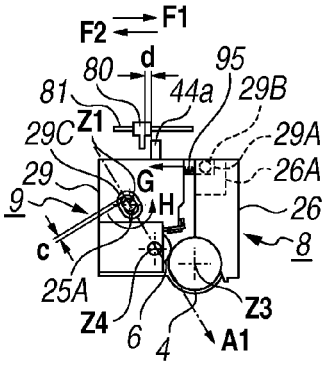
FIGS. 8A through 8F are side views and top views of a process cartridge according to a third exemplary embodiment.
Figure 8B:
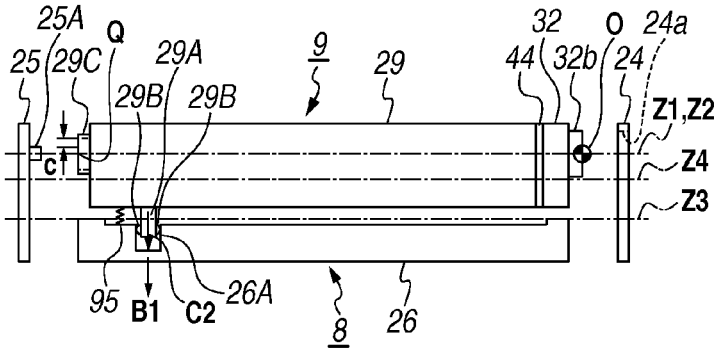
Figure 8C:
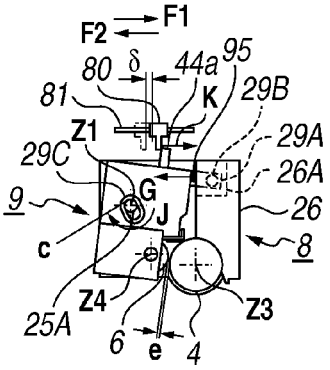
Figure 8D:
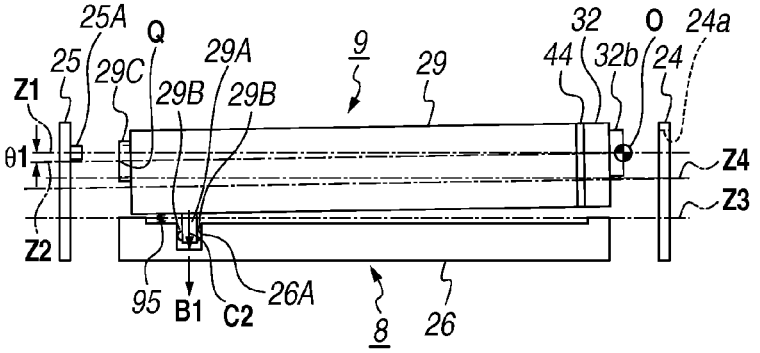

FIGS. 8A and 8C are side views, as seen from the non-driving side, of the process cartridge P. For the sake of illustration, part of the non-driving side cartridge cover 25 is not depicted. However, the protrusion 25*a* is depicted for the sake of illustration. FIGS. 8B and 8D are top views of the process cartridge P as seen from above.

Figure 8E:
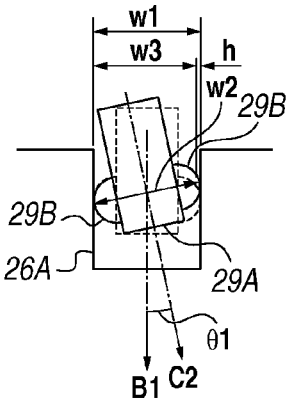
Figure 8F:
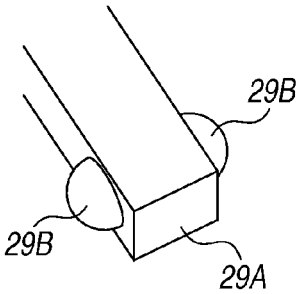

In the following, the positional relationship between the developing unit 9, the driving side cartridge cover 24 rotatably supporting the developing unit 9, and the non-driving side cartridge cover 25 will be described. For this purpose, FIGS. 8B and 8D schematically illustrate the driving side cartridge cover 24 and the non-driving side cartridge cover 25, respectively, in which they have moved away from the developing unit 9 in the longitudinal direction. The drum 4, the developing roller 6, the main body separation member 80, and the rail 81 are not illustrated. FIG. 8E is a top view of the process cartridge P as seen from above. It is a schematic diagram in which the engagement region between the regulating portion 26A and the regulated portion 29A are enlarged. FIG. 8F is a perspective view of the process cartridge P as seen from the non-driving side, and it is a schematic diagram which enlarges the regulated portion 29A. FIGS. 8A and 8B illustrate the contact position where the developing roller 6 is held in contact with the drum 4. The main body separation member 80 and the protrusion 44*a* are separated from each other with a gap d. FIGS. 8C and 8D illustrate the separation position in which the main body separation member 80 has moved a distance 5 from the contact position in the direction of the arrow F1 and in which the developing roller 6 is separated from the drum 4 with a gap e.

The operation in which the main body separation member 80 moves in the direction F1 and in which the developing unit 9 moves from the contact position to the separation position will be referred to as the separation operation. The operation in which the main body separation member moves in the direction F2 and in which the developing unit 9 moves from the separation position to the contact position will be referred to as the contact operation. In the following, the contact position and the separation position will be described.

[Description of the Contact Position]

As illustrated in FIG. 8A, at the contact position, the non-driving side of the developing unit 9 is urged in the direction of the arrow G by the pressure spring 95. Further, as illustrated in FIG. 13, the driving side of the developing unit 9 receives a moment in the direction of the arrow H around the developing unit support axis Z1 owing to the rotational drive force from the image forming apparatus main body 2. As a result, it is possible to hold the developing roller 6 in contact with the drum 4 with a predetermined pressure. Further, as illustrated in FIGS. 8A and 8C, the non-driving side support hole 29C extends straight in the lateral direction.

This construction is employed in order to reliably bring the developing roller 6 into contact with the drum 4 even if the alignment of the developing unit axis Z2 and the developing roller axis Z4 is deviated. In the present exemplary embodiment, the non-driving side support hole 29C and the protrusion 25*a* can relatively move. That is, the position of the rotation center of the developing unit relative to the drum unit 8 is slidable on the non-driving side of the process cartridge P. As a result, on the non-driving side, the developing unit 9 can move relative to the drum unit 8 in a direction crossing the axis of the drum 4. That is, on the non-driving side, the developing roller 6 can move to the drum 4, and, through this movement, it is possible to reliably bring the developing roller 6 into contact with the drum 4.

Figure 14:
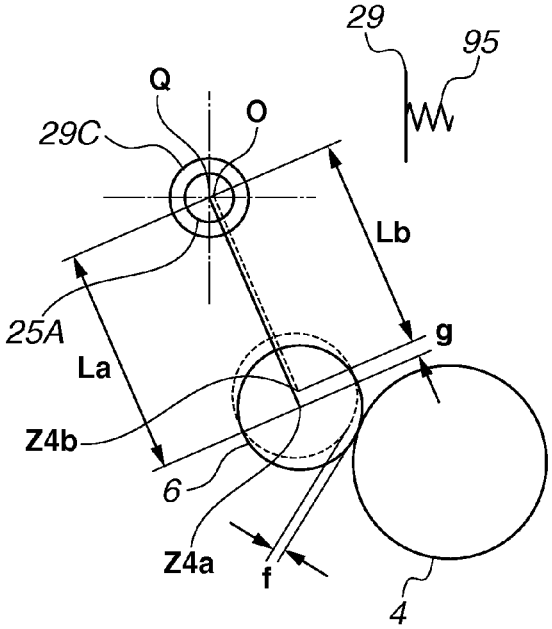
FIG. 14 is a schematic side view of the process cartridge for illustrating the third exemplary embodiment.

In the following, the relationship between the deviation in the alignment of the developing unit axis Z2 and the developing roller axis Z4, and the position of the developing roller 6 relative to the drum 4 will be described with reference to FIGS. 14 and 15 in a case where the non-driving side support hole 29C is not extended, and a case where it is extended. FIGS. 14 and 15 are side views of the process cartridge P as seen from the non-driving side. FIG. 14 illustrates the case where the non-driving side support hole 29C is not extended straight in the lateral direction, and FIG. 15 illustrates the case where the non-driving side support hole 29C is extended straight in the lateral direction.

For the sake of illustration, solely the non-driving side support hole 29C of the developing frame member 29, the developing roller 6, the drum 4, and the pressure spring 95 are depicted. The driving side developing roller 6 is indicated by a broken line. Further, the distance between the center Q of the non-driving side support hole 29C of the developing frame member 29 and the position Z4*a* of the developing roller axis Z4 at the non-driving side end of the developing roller 6 as seen from the non-driving side of the drum axis Z3 will be referred to as the non-driving side distance La. Further, the distance between the center O of the cylindrical portion 32*b* of the developing cover member 32 and the position Z4*b* of the developing roller axis Z4 at the driving side end of the developing roller 6 will be referred to as the driving side distance Lb.

As described above, the developing roller 6 is rotatably supported by the developing frame member 29 via the driving side bearing 44 and the non-driving side bearing 45 fixed to both ends in the longitudinal direction of the developing frame member 29. Due to variation or the like in the fixation positions of the driving side bearing and the non-driving side bearing 45 relative to the developing frame member 29, there is the possibility that the alignment of the developing roller 6 relative to the developing frame member 29 is deviated, so that the non-driving side distance La and the driving side distance Lb are not always equal to each other. The difference between the non-driving side distance La and the driving side distance Lb will be referred to as the distance g. For example, when La>Lb, FIG. 14 illustrates the positional relationship between the drum 4 and the developing roller when the non-driving side support hole 29C is not extended straight in the lateral direction. Since the non-driving side distance La is larger than the driving side distance Lb by the distance g, the non-driving side of the developing roller 6 comes into contact with the drum 4 first, and there is the possibility that the driving side of the developing roller is not brought into contact with the drum, leaving the gap f between them.

Figure 15A:
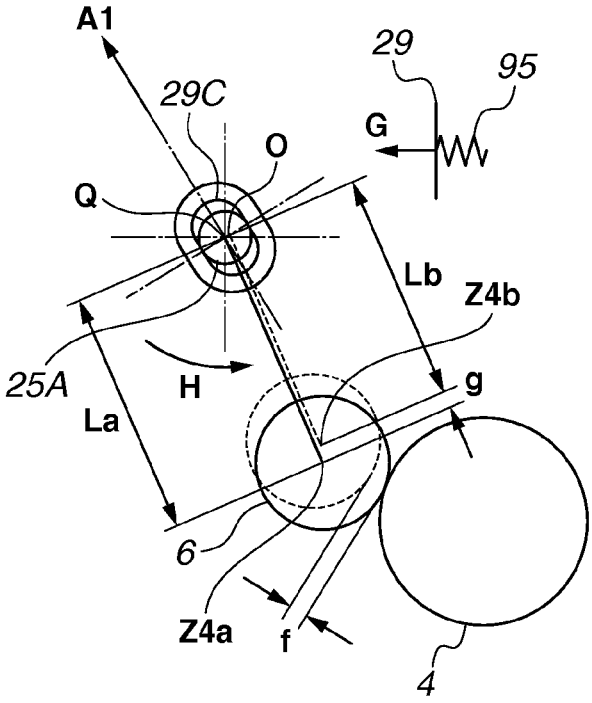
FIGS. 15A and 15B are schematic side views of the process cartridge according to the third exemplary embodiment.
Figure 15B:
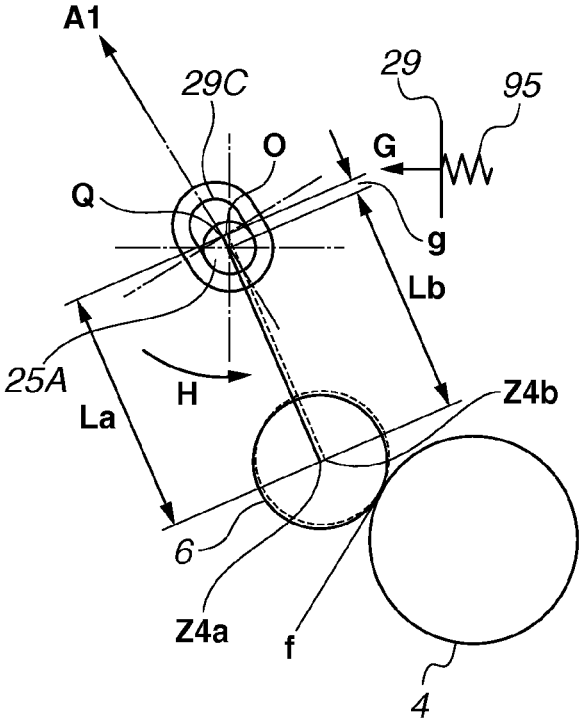

On the other hand, FIGS. 15A and 15B illustrate a change in the positional relationship between the drum 4 and the developing roller when La>Lb and when the non-driving side support hole 29C is an elongated hole extended straight in the extending direction A1. As illustrated in FIG. 15A, the non-driving side of the developing roller 6 comes into contact with the drum 4 first, so that the driving side is not brought into contact therewith, leaving the gap f therebetween. However, as illustrated in FIG. 15B, the urging force due to the pressure spring 95 acts on the developing frame member 29 in the direction of the arrow G. As a result, the developing unit 9 receives a moment in the direction of the arrow H, which rotates the developing unit 9. Further, the non-driving side support hole 29C of the developing unit 9 relatively moves a distance g with respect to the protrusion 25*a* of the non-driving side cartridge cover 25, along the extending direction A1 of the non-driving side support hole 29C, and moves to the position where La−g=Lb. As a result, the gap f is reduced to zero.

Thus, the non-driving side support hole 29C of the developing unit 9 is supported so as to be rotatable and slidable relative to the protrusion 25*a* of the drum unit 8, whereby it is possible to reliably bring the developing roller 6 into contact with the drum 4.

[Description of the Separation Position]

FIGS. 8C and 8D illustrate the state in which the developing roller 6 is separated from the drum 4 with a gap e. The position of the developing unit 9 relative to the drum unit 8 at this time will be referred to as the separation position. As illustrated in FIG. 8C, at the separation position, the main body separation member 80 has moved in the direction of the arrow F1 by a distance 5 and is engaged with the protrusion 44*a*. The non-driving side of the developing unit 9 is urged in the direction of the arrow G by the pressure spring 95.

On the other hand, the driving side of the developing unit 9 is pressed in the direction of the arrow K by the main body separation member 80 against the urging force due to the pressure spring 95. As a result, the non-driving side of the developing unit 9 moves along the extending direction A1 of the non-driving side support hole 29C until the gap c is eliminated. Further, by receiving a moment in the direction of the arrow J around the developing unit support axis Z1, the developing roller 6 rotates relative to the drum 4 to the position where it is separated therefrom by the gap e.

On the other hand, the driving side of the developing unit 9 rotates around the center O of the cylindrical portion 32*b* of the developing cover member 32, whereas it does not move in the lateral direction. As illustrated in FIG. 8D, at this time, the center Q of the non-driving side support hole 29C of the developing frame member 29 moves around the center O of the cylindrical portion 32*b* of the developing cover member 32 as seen from above the process cartridge P until the gap c is eliminated. As a result, the developing unit axis Z2 inclines relative to the developing unit support axis Z1 by an angle θ1. The engagement region between the regulating portion 26A of the drum unit 8 and the regulated region 29A of the developing unit 9 at this time will be described with reference to FIGS. 8E and 8F.

FIG. 8E is a top view of the process cartridge P as seen from above. It is a schematic diagram in which the engagement region between the regulating portion 26A and the regulated portion 29A is enlarged. FIG. 8F is a perspective view of the process cartridge P as seen from the non-driving side. It is a schematic diagram with the regulated portion 29A enlarged. When the developing unit axis Z2 inclines relative to the developing unit support axis Z1 by the angle θ1, the depth direction B1 of the regulating portion 26A and the height direction C2 of the regulated portion 29A also incline by the angle θ1.

As illustrated in FIGS. 8E and 8F, the regulated portion 29A has a semi-spherical curved surface 29B on the surface opposite the regulating portion 26A. This curved surface 29B is swollen (convex) toward the regulating portion 26A from the regulated portion 29A. The curved surface 29B is provided in the region where the regulated portion 29A is engaged with the regulating portion 26A.

Assuming that the width in the longitudinal direction of the regulating portion 26A is w1, and that the width of the curved surface 29B of the regulated portion 29A is w2, w1=w2. In the state in which the regulating portion 26A and the regulated portion 29A incline by the angle θ1, the width w3 in the longitudinal direction of the regulated portion=w2 cos θ1=w1 cos θ1, relative to the width w1 in the longitudinal direction of the regulating portion 26A. At this time, between the regulating portion 26A and the regulated portion 29A, there is the longitudinal gap h=w1−w3=w1(1−cos θ1). The gap h>0.

As a result, it is possible to suppress high pressure contact between the regulating portion 26A and the regulated portion 29A.

As a result of the above arrangements, the regulated portion 29A can move relative to the regulating portion 26A without resistance, making it possible that the developing unit 9 performs the contact operation and the separation operation of relative to the drum unit 8 in a stable manner. Further, by suppressing high pressure contact between the regulating portion 26A and the regulated portion 29A, it is possible to suppress mutual scraping of the regulating portion 26A and the regulated portion 29A. Thus, even if the cartridge is used for a long period of time, it is possible for the regulating portion 26A and the regulated portion 29A to perform in a stable manner the positioning in the longitudinal direction of the developing unit relative to the photosensitive member unit.

Further, in the present exemplary embodiment, the non-driving side of the developing unit 9 is supported so as to be rotatable relative to the drum unit 8 and slidable along the non-driving side support hole 29C. Thus, on the non-driving side of the developing unit 9, the movement amount relative to the drum unit 8 is larger than on the driving side. In the present exemplary embodiment, however, the regulating portion 26A is provided on the non-driving side of the drum unit 8, and the regulated portion 29A is provided on the non-driving side of the developing unit 9. That is, the distance from the regulated portion 29A to the non-driving side support hole 29C is shorter than the distance from the regulated portion 29A to the cylindrical portion 32*b*.

As a result, also on the non-driving side, where the movement amount of the developing unit 9 relative to the drum unit 8 is large, it is possible to suppress high pressure contact of the regulating portion 26A with the regulated portion. As a result, it is possible to perform positioning in the longitudinal direction of the developing unit relative to the photosensitive member unit.

Figure 21A:
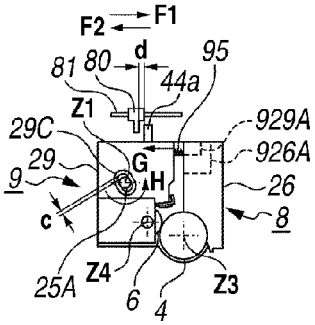
FIGS. 21A through 21E are side views and top views of a process cartridge according to a comparative example.
Figure 21B:
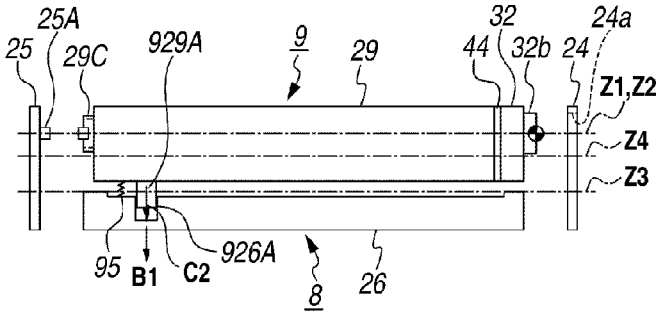
Figure 21C:
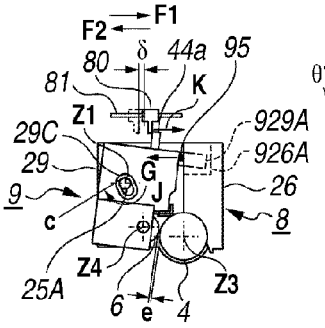

On the other hand, FIGS. 21A through 21E illustrate a process cartridge P according to a comparative example. FIGS. 21A and 21C are side views of the process cartridge P according to the comparative example as seen from the non-driving side. For the sake of illustration, part of the non-driving side cartridge cover 25 is not depicted.

Figure 21D:
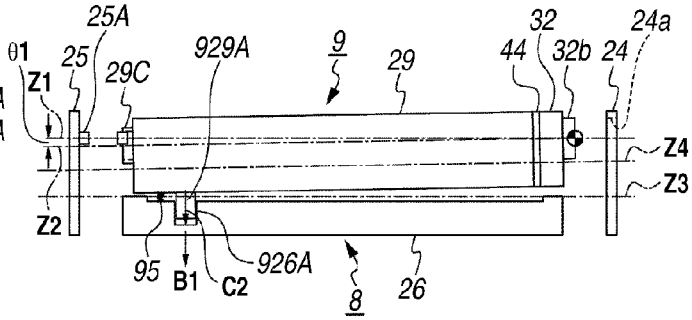

FIGS. 21B and 21D are top views, as seen from above, of the process cartridge P according to the comparative example. In the following, the positional relationship between the developing unit 9, the driving side cartridge cover 24 rotatably supporting the developing unit 9, and the non-driving side cartridge cover 25 will be described. To that end, like FIGS. 8B and 8D, FIGS. 21B and 21D schematically illustrate the state in which the driving side cartridge cover 24 and the non-driving side cartridge cover 25 are moved in the longitudinal direction away from the developing unit 9.

Figure 21E:
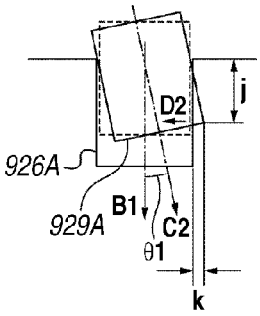

The drum 4, the developing roller 6, the main body separation member 80, and the rail 81 are not illustrated. FIG. 21E is a top view as seen from above of the process cartridge P according to the comparative example. It is a schematic diagram in which the engagement region of a regulating portion 926A and a regulated portion 929A are enlarged. As illustrated in FIGS. 21A through 21E, in the comparative example, the curved surface 29B is not provided on the regulated portion 929A.

Thus, when the developing unit axis Z2 inclines relative to the developing unit support axis Z1 by the angle θ1 as illustrated in FIG. 21D, the depth direction B1 of the regulating portion 926A and the height direction C2 of the regulated portion 929A incline by the angle θ1. FIG. 21D is a diagram illustrating, the process cartridge P, the developing unit axis Z2 and the developing unit support axis Z1 from above, when the developing unit is at the separation position.

Assuming that the depth in the lateral direction of the engagement region of the regulating portion 926A and the regulated portion 929A is j, at the position of the depth j, the regulated portion 929A interferes with the regulating portion 926A in the longitudinal direction by a distance k=j sin θ1, resulting in a pressure-forcing relationship. In this state, the regulating portion 926A and the regulated portion 929A are held in contact with each other with high pressure.

Further, a drag in the direction of the arrow D2 is generated in the regulated portion 929A, so that the resistance when the regulated portion 929A moves relative to the regulating portion 926A increases, with the result that the contact operation and the separation operation of the developing unit 9 relative to the drum unit 8 become unstable. To prevent this, it might be possible to enlarge the gap between the regulating portion 926A and the regulated portion 929A. In that case, however, there is the possibility that the position in the longitudinal direction of the developing unit 9 relative to the drum unit 8 is deviated. As a result, there is the possibility that a defective image is generated.

On the other hand, in the construction according to the present exemplary embodiment, it is possible to prevent the regulating portion 26A and the regulated portion 29A from being held in contact with each other with high pressure.

In the present exemplary embodiment, to hold the developing roller 6 in contact with the drum 4 with a predetermined pressure, there are used the forces of the urging force due to the pressure spring 95 and the rotational drive force from the image forming apparatus main body 2. However, the exemplary embodiment is not limited thereto. It is also possible to press the developing roller 6 against the drum 4 with only one of the above forces.

Further, in the present exemplary embodiment, the non-driving side cartridge cover 25 is provided with the protrusion 25*a* as the support portion on the non-driving side, and the developing frame member 29 is provided with the non-driving side support hole 29C as the non-driving side supported portion. And, the protrusion 25*a* and the non-driving side support hole 29C are engaged with each other. However, it is also possible to provide the non-driving side cartridge cover 25 with a hole portion as the non-driving side support portion, and to provide the developing frame member 29 with a protrusion as the non-driving side supported portion.

Figure 16:
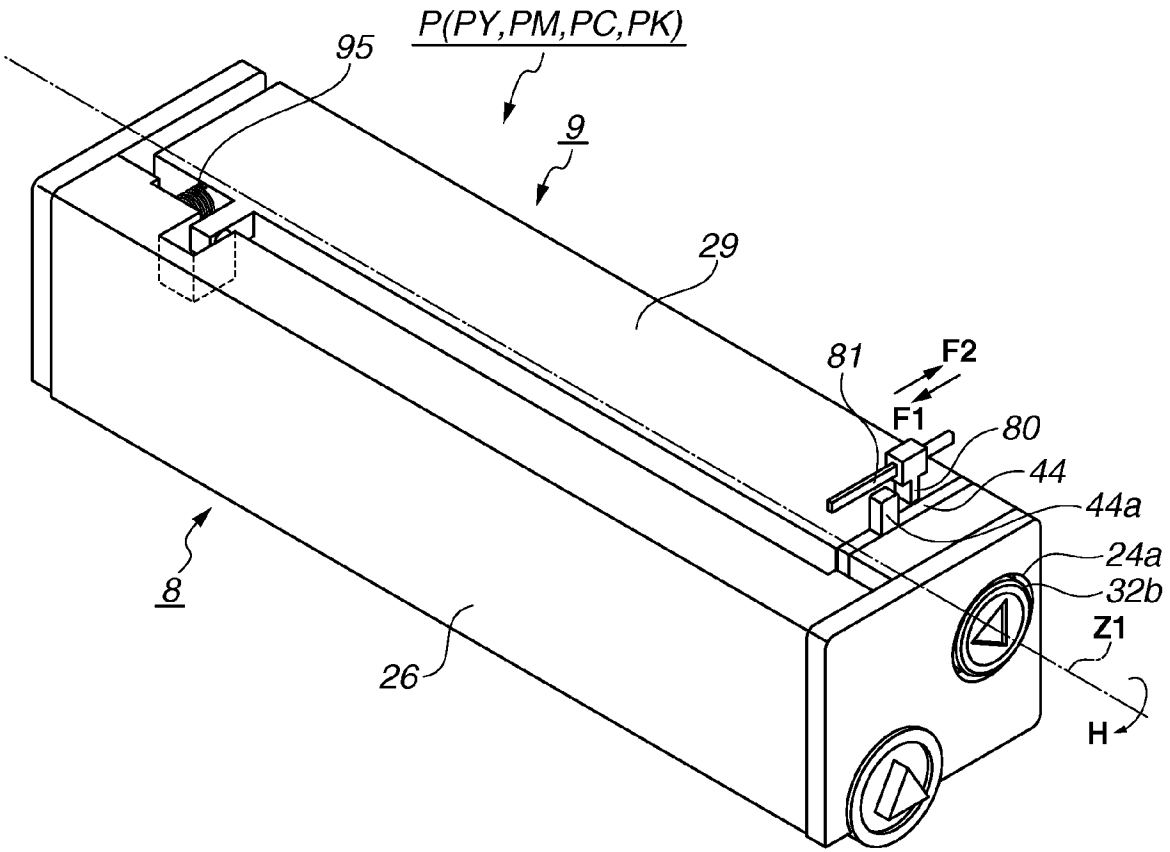
FIG. 16 is a perspective view of the process cartridge according to the third exemplary embodiment.

Further, in the present exemplary embodiment, to bring the developing roller 4 and the photosensitive drum 6 into and out of contact with each other, the developing unit 9 is rotatably supported relative to the drum unit 8. However, as illustrated in FIG. 16, it is also possible to extend the driving side support hole 24*a* of the driving side cartridge cover 24 straight in the lateral direction, and to make the developing unit 9 slidable relative to the drum unit 8.

Further, it is also possible to form a curved surface similar to the curved surface 29B described in connection with the present exemplary embodiment on the first regulating portion 26*b* or the second regulating portion 26*c* (See FIG. 1).

Further, in the present exemplary embodiment, to bring the developing roller 4 and the photosensitive drum 6 into and out of contact with each other, the developing unit 9 of the process cartridge P which can be detachably attached to the image forming apparatus main body 2 is supported so as to be movable relative to the drum unit 8. However, it is also possible to separate the developing unit (developing device) from the drum unit, making it detachably attachable relative to the image forming apparatus main body 2. This will be described below. Regarding a construction equivalent to that of the above exemplary embodiment, a description thereof will be left out.

Figure 22:
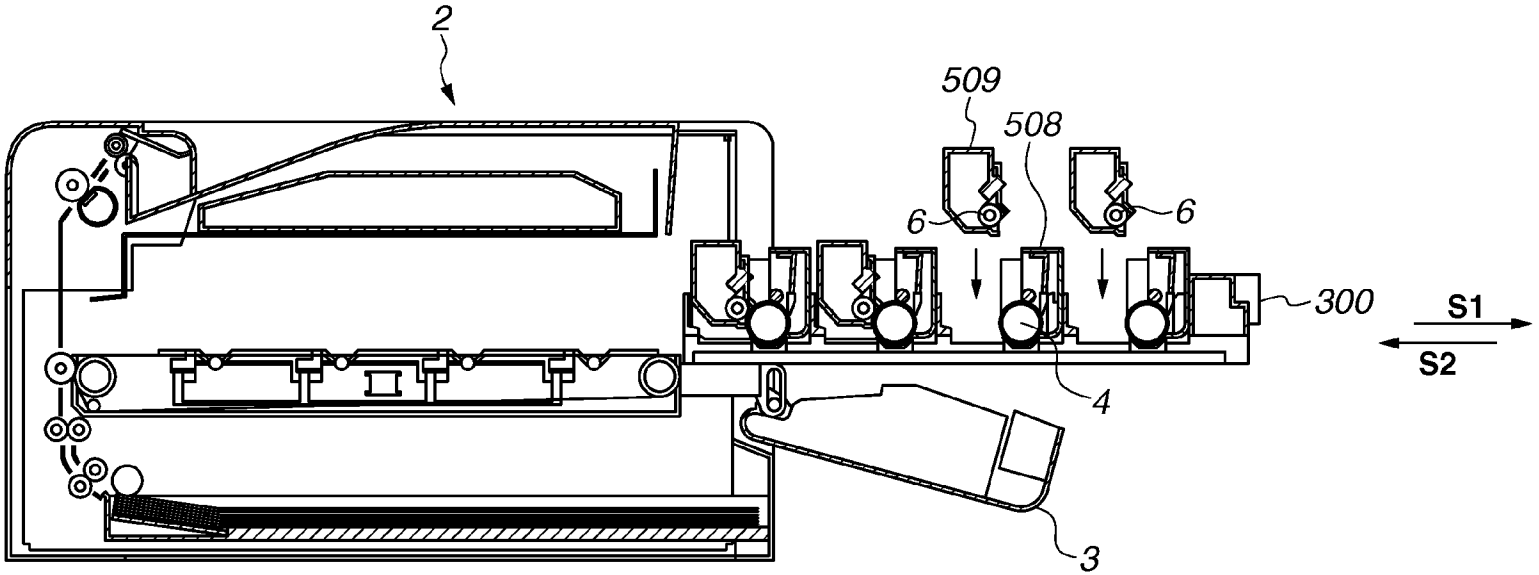
FIG. 22 is a schematic diagram illustrating an image forming apparatus.

FIG. 22 is a sectional view of an image forming apparatus according to a modification of the present exemplary embodiment. A moving member 300 is drawn out of the apparatus main body 2 in the direction S1, and a cartridge-like developing device (hereinafter referred to as the developing cartridge) 509 having the developing roller 6 can be detachably attached to the apparatus main body 2. A drum unit 508 having the photosensitive member 4 is fixed to the moving member 300.

Figure 23A:
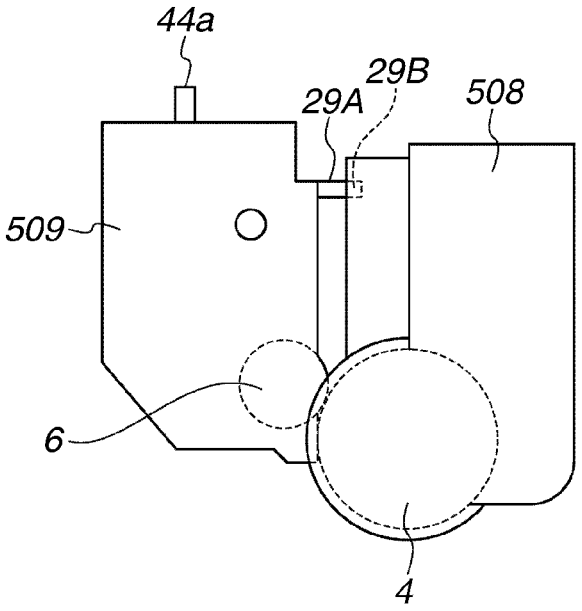
FIGS. 23A and 23B are schematic diagrams illustrating a development cartridge.
Figure 23B:
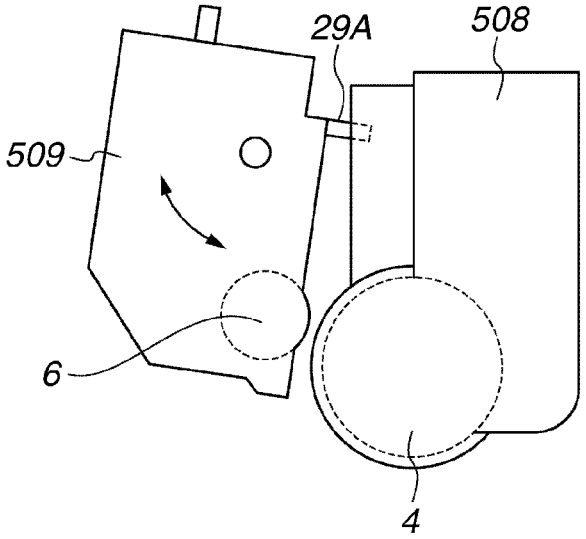

By moving the moving member 300 with the developing cartridge 509 attached thereto in the direction S2, the developing cartridge 509 is attached to the apparatus main body 2. As illustrated in FIG. 23, this developing cartridge 509 is movable relative to the drum unit 508. FIG. 23 is a schematic diagram illustrating the developing cartridge 509 and the drum unit 508, with the developing cartridge 509 rotatable relative to the drum unit 508.

In this connection, as in the case of the developing unit 9, the developing cartridge 509 may be provided with the regulated portion 29A and the curved surface 29B, and the drum unit 508 may be provided with the regulating portion 26A (See FIG. 8B) to be engaged with this regulated portion 29A. In this modification, the regulating portion 26A may be provided not on the drum unit 508 but on some other portion of the apparatus main body 2, such as the moving member 2.

Figure 17A:
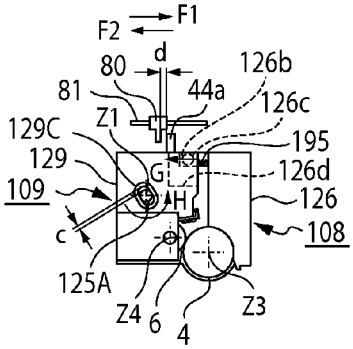
FIGS. 17A and 17B are a side view and a top view of a process cartridge according to a fourth exemplary embodiment.

Next, a fourth exemplary embodiment will be described with reference to FIG. 17. The basic apparatus construction according to the present exemplary embodiment is the same as that of the third exemplary embodiment described above, so the components that are common to these exemplary embodiments will be omitted. Further, the members of the same function as those of the third exemplary embodiment described above are indicated by the same reference numerals. FIG. 17A is a side view of the process cartridge P as seen from the non-driving side.

Figure 17B:
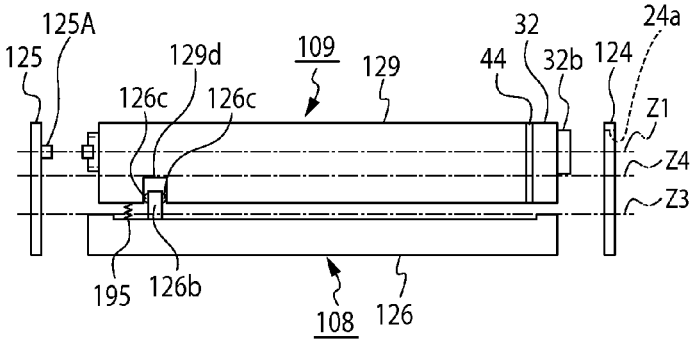

For the sake of illustration, part of a non-driving side cartridge cover 125 is not depicted. FIG. 17B is a top view of the process cartridge P as seen from above. In the following, the positional relationship between a developing unit 109, a driving side cartridge cover 124 rotatably supporting the developing unit 109, and the non-driving side cartridge cover 125 will be described. To that end, FIG. 17B schematically illustrates the state in which the driving side cartridge cover 124 and the non-driving side cartridge cover 125 have been moved in the longitudinal direction away from the developing unit 109. The drum 4, the developing roller 6, the main body separation member 80, and the rail 81 are not illustrated.

In the third exemplary embodiment described above, the curved surface 29B of the regulated portion 29A of the developing unit 9 is engaged with the regulating portion 26A of the drum unit 8. On the other hand, as illustrated in FIG. 17, a regulating portion 126*b* may be provided so as to be convex relative to a cleaning container 126 of a drum unit 108. In this case, the regulating portion 126*b* has a curved surface 126*c*, and a regulated portion 129*d* is provided so as to be concave relative to a frame member 129 of the developing unit 109. Other than that, the present exemplary embodiment is of the same construction as the third exemplary embodiment described above. The curved surface 126*c* of the regulating portion 126*b* and the regulated portion 126*d* are engaged with each other, whereby it is possible to attain the same effect as that of the third exemplary embodiment.

That is, one of the regulating portion and the regulated portion is formed as a convex portion, and the other portion is formed as a concave portion, with the convex portion provided with a curved surface.

Figure 18A:
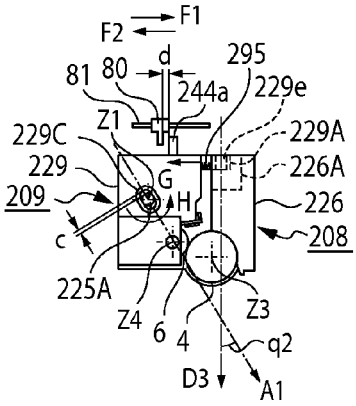
FIGS. 18A through 18F are side views and top views of a process cartridge according to a fifth exemplary embodiment.
Figure 18B:
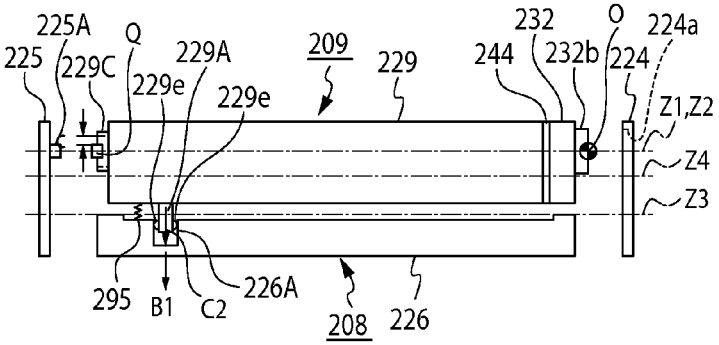
Figure 18C:
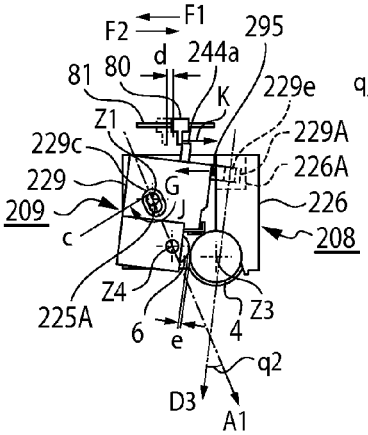
Figure 18D:
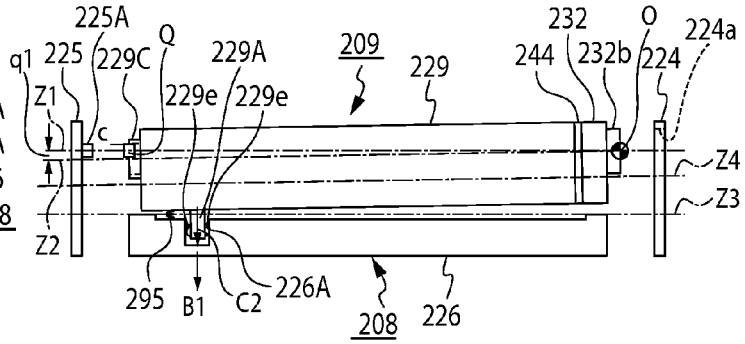

Next, a fifth exemplary embodiment will be described with reference to FIGS. 18A through 18F. The basic apparatus construction of the present exemplary embodiment is the same as that of the third exemplary embodiment described above, so a redundant description will be left out. The members of the same function as those of the third exemplary embodiment described above are indicated by the same reference numerals. The reference labels 224*a*, 226, 229, 232, 232*b*, 244, 244*a* and 295 of the fifth embodiment shown in FIGS. 18A-18D correspond to reference labels 24*a*, 26, 29, 32, 32*b*, 44, 44*a* and 95 of the third embodiment shown in FIGS. 8A-8D, respectively. FIGS. 18A and 18C are side views of the process cartridge P as seen from the non-driving side. For the sake of illustration, part of a non-driving side cartridge cover 225 is not depicted. FIGS. 18B and 18D are top views of the process cartridge P as seen from above.

Figure 18E:
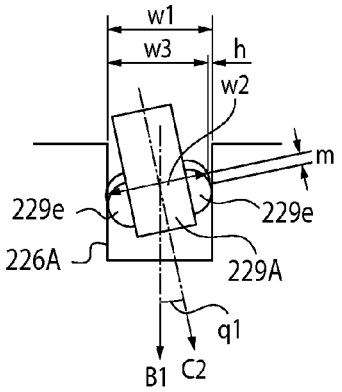
Figure 18F:
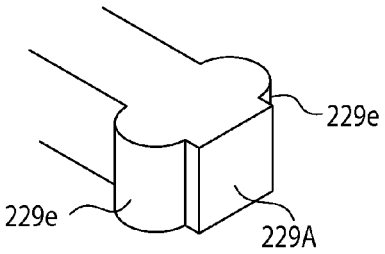

The positional relationship between a developing unit 209, a driving side cartridge cover 224 rotatably supporting the developing unit 209, and the non-driving side cartridge cover 225 will be described. To that end, FIGS. 18B and 18D schematically illustrate the state in which the driving side cartridge cover 224 and the non-driving side cartridge cover 225 have moved in the longitudinal direction away from the developing unit 209. The drum 4, the developing roller 6, the main body separation member 80, and the rail 81 are not illustrated. FIG. 18E is a top view of the process cartridge P as seen from above. It is a schematic diagram in which the engagement region of a regulating portion 226A and a regulated portion 229A are enlarged. FIG. 18F is a perspective view of the process cartridge P as seen from the non-driving side, with the enlarged regulated portion 229A.

In the third exemplary embodiment described above, the regulated portion 29A of the developing unit 9 has the curved surface 29B. On the other hand, as illustrated in FIG. 18F, a construction may be possible in which a regulated portion 229A has a curved surface 229*e*, which is an extension in the lateral direction of the curved surface 29B of the third exemplary embodiment.

In the present construction, the curved surface 229*e* is extended in the lateral direction, i.e., a direction crossing the longitudinal direction, whereby it is possible to enlarge (the area of) the engagement region of the curved surface 229*e* and the regulating portion 226A. As a result, the drag per unit length at the time of engagement is reduced, whereby movement of the regulated portion 229A relative to the regulating portion 226A is possible with little resistance. The contact operation and the separation operation of the developing unit 209 relative to the drum unit 208 can be performed in a more stable manner.

Further, as illustrated in FIGS. 18A and 18C, the extending direction D3 of a curved surface 229*e* crosses the extending direction A1 of a non-driving side support hole 229C at an angle θ2. And, as illustrated in FIG. 18D, in the state in which the regulating portion 226A and the regulated portion 229A incline at the angle θ1, the regulating portion 226A and the curved surface 229*e* of the regulated portion 229A are engaged with each other.

The engagement region of the regulating portion 226A of the drum unit 208 and of the regulated portion 229A of the developing unit 209 will be described in detail with reference to FIG. 18E. FIG. 18E is a top view of the process cartridge P as seen from above. It is a schematic diagram in which the engagement portion of the regulating portion 226A and the regulated portion 229A are enlarged. As in the third exemplary embodiment described above, assuming that the width in the longitudinal direction of the regulating portion 226A is w1, and that the width of the curved surface 229*e* of the regulated portion 229A is w2, w1=w2.

Suppose the distance between one end side and the other end side of the curved surface 229*e* when the process cartridge P is seen from above is m. In this case, in the state in which the regulating portion 226A and the regulated portion 229A incline at the angle θ1, the width w3 in the longitudinal direction of the regulated portion 229A=w2 cos θ1+m sin θ1=w1 cos θ1+m sin θ1. Thus, relative to the width w1 in the longitudinal direction of the regulating portion 226A, the distance m is set such that the width w3 in the longitudinal direction of the regulated portion 229A=w1 cos θ1+m sin θ1<w1. As a result, the gap h between the regulating portion 226A and the curved surface 229*e*=W1−W3>0. As a result, it is possible to suppress high pressure contact between the regulating portion 226A and the regulated portion 229A.

As a result, the regulated portion 229A can move relative to the regulating portion 226A without meeting any resistance, making it possible to perform the contact operation and the separation operation of the developing unit 209 relative to the drum unit 208 in a stable manner. Further, it is possible to suppress generation of scraping due to contact with high pressure of the regulating portion 226A and the regulated portion 229A.

Figure 19A:
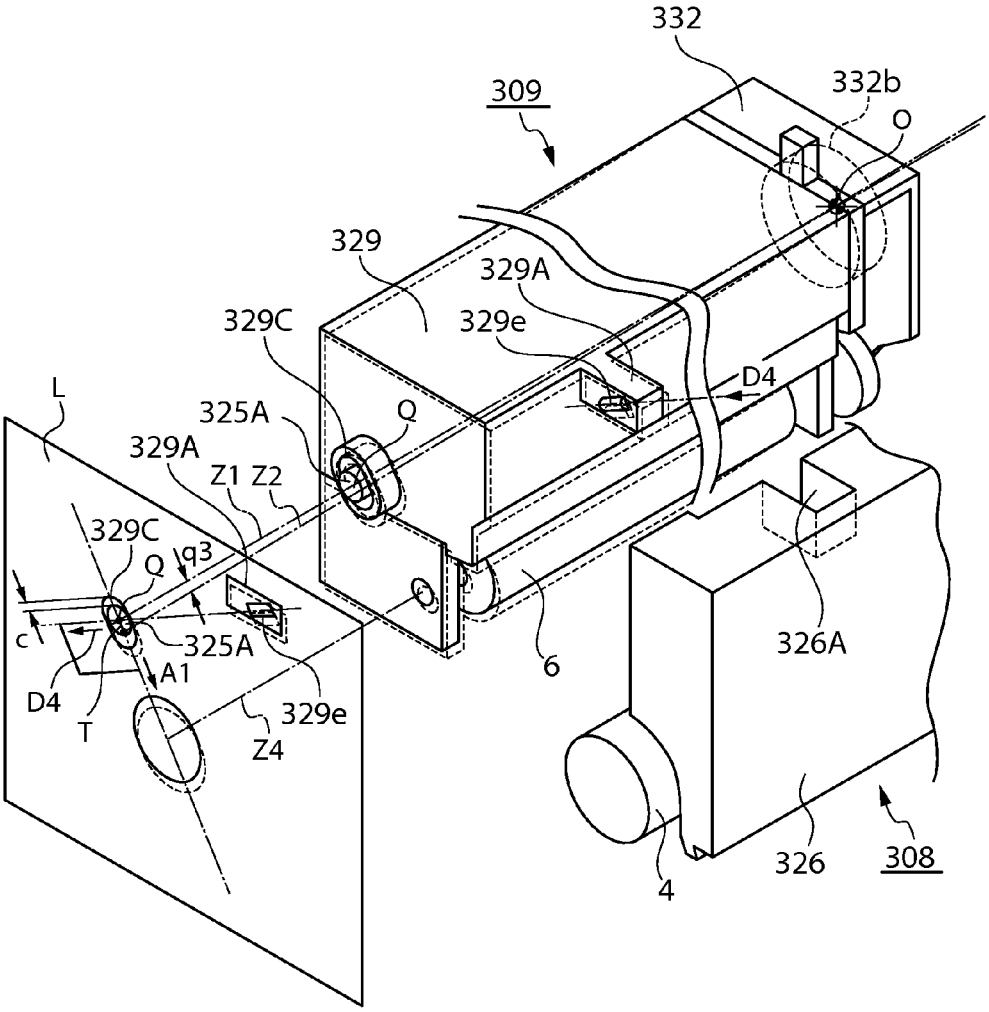
FIGS. 19A and 19B are a perspective view and a view as seen from the direction of an arrow of a process cartridge according to a sixth exemplary embodiment.

Next, a sixth exemplary embodiment will be described with reference to FIG. 19. The basic apparatus construction of the present exemplary embodiment is the same as that of the third exemplary embodiment described above, so that a redundant description thereof will be left out. The members of the same function as those of the third exemplary embodiment described above are indicated by the same reference numerals. The reference labels 325A, 326 and 329 of the sixth embodiment shown in FIG. 19A correspond to reference labels 25A, 26 and 29 of the third embodiment shown in FIG. 8A, respectively. FIG. 19A is perspective view illustrating part of the non-driving side and the driving side of the process cartridge P. For the sake of illustration, non-driving side cartridge cover 325 and a pressure spring 395 are not depicted. Further, the state is described by a broken line in which the non-driving side of a developing unit 309 has moved along the extending direction A1 of a non-driving side support hole 329C until the gap c is eliminated. Further, a plane L is a projection plane when the process cartridge P is seen from the non-driving side direction. That is, the plane L is a plane perpendicular to the axis of the developing roller.

Figure 19B:
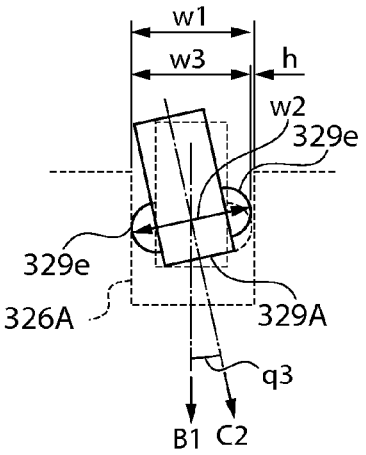

FIG. 19B is a schematic diagram illustrating a regulated portion 329A from the extending direction D4 of a curved surface 329*e*.

In the fifth exemplary embodiment described above, as seen from the non-driving side, the extending direction D3 of the curved surface 229*e* and the extending direction C2 of the regulated portion 229A cross each other at the angle θ2. On the other hand, as illustrated in FIGS. 19A and 19B, a construction may be possible in which, in the plane L, the extending direction D4 of the curved surface 329*e* and the extending direction A1 of the non-driving side support hole 329C are orthogonal to each other. Here, suppose the center Q of the non-driving support hole 329C of the driving unit 9 has moved around the center O of the cylindrical portion 332*b* of the developing cover member 332 along the extending direction A1 of the non-driving side support hole 329C until the gap c is eliminated. The locus of the intersection of the developing unit axis Z2 which is an axis connecting the center O and the center Q and the plane L will be referred to as the locus T.

The locus T is parallel to the extending direction A1 of the non-driving side support hole 329C. Further, in the present exemplary embodiment, the extending direction A1 of the non-driving side support hole 329C and the extending direction D4 of the curved surface 329*e* are orthogonal to each other, so that the locus T and the extending direction D4 of the curved surface 329*e* are orthogonal to each other. Thus, the developing unit axis Z2 and the developing unit support axis Z1 incline around the center O of the cylindrical portion 332*b* of the developing cover member 332 by an angle θ3 as seen from the direction of the arrow D4. The engagement region of the regulating portion 326A of the drum unit 308 and the regulated portion 329A of the developing unit 309 at this time will be described in detail with reference to FIG. 19B.

FIG. 19B is a diagram illustrating the process cartridge P as seen from the direction of the arrow D4. It is a schematic diagram in which the engagement region of the regulating portion 326A and the regulated portion 329A is enlarged. As in the case of the third exemplary embodiment described above, assuming that the width in the longitudinal direction of the regulating portion 326A is w1, and that the width of the curved surface 329*e* of the regulated portion 329A is w2, w1=w2. In the state in which the regulating portion 326A and the regulated portion 329A incline by the angle θ3, relative to the width w1 in the longitudinal direction of the regulating portion 326A, the width w3 in the longitudinal direction of the regulated portion 329A=w2 cos θ3=w1 cos θ3.

At this time, between the regulating portion 326A and the curved surface 329*e*, there is the longitudinal gap h=w1−w3=w1(1−cos θ3)>0. As a result, it is possible to prevent the regulating portion 326A and the regulated portion 329A from being held in contact with each other with high pressure. As a result, the regulated portion 329A can move relative to the regulating portion 326A without meeting any resistance, making it possible to perform the rotation (the contact operation and the separation operation) of the developing unit 309 relative to the drum unit 308 in a stable manner.

To summarize the above, in the present exemplary embodiment, the direction in which the non-driving side support hole 329C extends, i.e., the direction in which the non-driving side support hole 329C is displaced relative to the drum unit 308, are orthogonal to the direction in which the curved surface 329*e* extends. As a result, it is possible to further suppress generation of scraping of the regulated portion 329A, etc.

In the fifth exemplary embodiment described above, it is necessary to set the distance m between one end side and the other end side of the curved surface 229*e* such that the gap h>0. On the other hand, according to the present exemplary embodiment, the gap h>0 independently of the distance n between one end side and the other end side of the curved surface 329*e*. Thus, it is possible for the distance m to be larger than in the fifth exemplary embodiment, making it possible to enlarge the engagement region of the curved surface 329*e* and the regulating portion 326A. As a result, the drag per unit length at the time of engagement is reduced, whereby relative movement is possible, with the resistance of the regulated portion 329A relative to the regulating portion 326A being small. It is possible to perform the contact operation and separation operation of the developing unit 309 relative to the drum unit 308 in a more stable manner.

While it is most desirable for the direction in which the non-driving side support hole 329C extends to be orthogonal to the direction in which the curved surface 329*e* extends, the exemplary embodiment is not necessarily limited thereto. The desired effect can be attained so long as the direction in which the non-driving side support hole 329C extends and the direction in which the curved surface 329*e* extends cross each other.

Figure 20A:
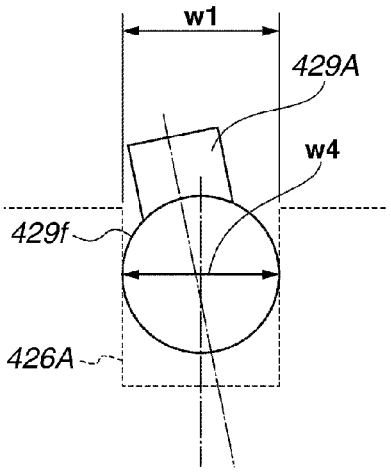
FIGS. 20A and 20B are enlarged top views of a process cartridge according to a seventh exemplary embodiment.
Figure 20B:
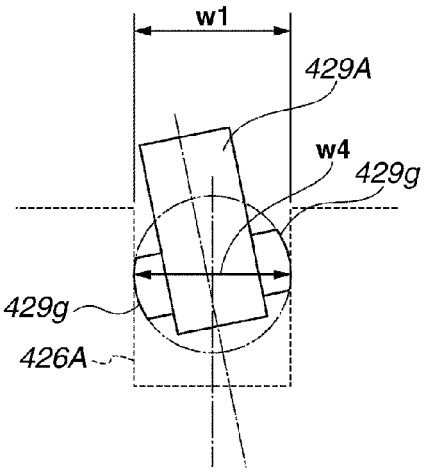

Next, a seventh exemplary embodiment will be described with reference to FIGS. 20A and 20B. The basic apparatus construction of the present exemplary embodiment is the same as that of the third embodiment described above, so a redundant description thereof will be left out. The members of the same function as those of the third exemplary embodiment described above are indicated by the same reference numerals. FIGS. 20A and 20B are top views of the process cartridge P as seen from above. They are schematic diagrams in which the engagement region of a regulating portion 426A and a regulated portion 429A is enlarged.

While in the third exemplary embodiment the curved surface provided on the regulated portion is of a semi-spherical configuration, the regulated portion may have a spherical configuration of a diameter w4 as a curved surface 429*f* as illustrated in FIG. 20A, or may have a part of the spherical configuration of the diameter w4 as a curved surface 429*g* as illustrated in FIG. 20B. That is, the curved surface provided on the regulated portion 429A may be of a spherical configuration or a part thereof. In the above construction, the width w4 in the longitudinal direction of the regulated portion 429A is kept constant relative to the width w1 in the longitudinal direction of the regulating portion 426A, making it possible to prevent the regulating portion 426*a* and the regulated portion 429A from being held in contact with each other with high pressure.

As a result, the regulated portion 429A can move relative to the regulating portion 426A without meeting any resistance, making it possible to perform the contact operation and separation operation of the developing unit 409 relative to the drum unit 408 in a more stable manner. Further, it is possible to suppress generation of scraping due to interference.

Finally, the effect of the third through seventh exemplary embodiments described above may be summarized as follows: It is possible to suppress movement of the developing unit in the axial direction of the developer carrying member without preventing the developing unit (developing device) from performing the operation of bringing the developer carrying member into and out of contact with the photosensitive drum. That is, it is possible to maintain the position in the axial direction of the developing unit with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-199359, filed Sep. 11, 2012 and No. 2012-203089, filed Sep. 14, 2012 which are hereby incorporated by reference herein in their entirety.

What is claimed is:

1. A process cartridge detachably attachable to an apparatus main body of an image forming apparatus, comprising:

a drum unit having a photosensitive drum; and a developing unit having a developing roller and connected to the drum unit such that the developing unit is movable between a contact position where the developing roller is held in contact with the photosensitive drum and a separation position where the developing roller is separated from the photosensitive drum, wherein both in the case where the developing unit is at the contact position and in the case where the developing unit is at the separation position, a first regulating portion that the drum unit has and a first regulated portion that the developing unit has, are engaged with each other, whereby movement of the developing unit with respect to the drum unit in the axial direction of the developing roller is regulated, wherein the first regulating portion or the first regulated portion is a protrusion that protrudes in a direction crossing the axial direction from either one of the drum unit and the developing unit to the other unit, wherein in the case where the developing unit is at the separation position, a second regulating portion that the drum unit has and a second regulated portion that the developing unit has, overlap each other in a direction perpendicular to the axial direction, and wherein in the case where the developing unit is at the contact position, the second regulating portion and the second regulated portion do not overlap each other in the direction perpendicular to the axial direction.

2. The process cartridge according to claim 1, wherein the width in the axial direction of the second regulating portion is larger than the width in the axial direction of the first regulating portion.

3. The process cartridge according to claim 1, wherein when the developing unit is at the separation position, the length of the region where the second regulating portion and the second regulated portion are engaged with each other is shorter than the length of the region where the first regulating portion and the first regulated portion are engaged with each other.

4. The process cartridge according to claim 1, wherein, at the separation position, a gap in the axial direction between the first regulating portion and the first regulated portion is smaller than a gap in the axial direction between the second regulating portion and the second regulated portion.

5. The process cartridge according to claim 1, wherein the developing unit has a toner storage portion for storing toner, and wherein the second regulating portion is provided within a range in the axial direction where the toner storage portion is arranged.

6. The process cartridge according to claim 1, wherein the drum unit has a waste toner storage portion for storing toner removed from the photosensitive drum, and wherein the second regulating portion is arranged within a range in the axial direction where the waste toner storage portion is arranged.

7. The process cartridge according to claim 1, wherein a region of at least one of the first regulating portion and the first regulated portion which are engaged with each other is formed as a curved surface.

8. The process cartridge according to claim 1, wherein a region of at least one of the second regulating portion and the second regulated portion which are engaged with each other is formed as a curved surface.

9. A process cartridge detachably attachable to an apparatus main body of an image forming apparatus, comprising:

a drum unit having a photosensitive drum;

a developing unit having a developing roller and connected to the drum unit such that the developing unit is movable between a contact position where the developing roller is held in contact with the photosensitive drum and a separation position where the developing roller is separated from the photosensitive drum;

a regulating portion provided on the drum unit; and a regulated portion provided on the developing unit and configured to be engaged with the regulating portion to regulate movement of the developing unit with respect to the drum unit in the axial direction of the developing roller, wherein at least one of the regulating portion and the regulated portion has a curved surface to be engaged with the other portion of the regulating portion and the regulated portion, wherein a one-end-side supported portion is provided at one end side of the developing unit in the axial direction of the developing roller, wherein the one-end-side supported portion is supported by the drum unit so as to be rotatable and slidable, wherein an other-end-side supported portion is provided at the other end side of the developing unit in the axial direction of the developing roller, and wherein the other-end-side supported portion is supported by the drum unit so as to be rotatable.

10. The process cartridge according to claim 9, wherein one of the regulating portion and the regulated portion is a protrusion, and wherein the curved surface is provided on the protrusion.

11. The process cartridge according to claim 9, wherein the curved surface protrudes from one of the regulating portion and the regulated portion toward the other.

12. The process cartridge according to claim 9, wherein when the one-end-side supported portion and the curved surface are projected onto a plane orthogonal to the axis of the developing roller, the curved surface extends in a direction crossing the direction in which the one-end-side supported portion slides.

13. The process cartridge according to claim 9, wherein the curved surface extends in a direction crossing the axis of the developing roller.

14. The process cartridge according to claim 9, wherein the curved surface is of a spherical configuration or constitutes a part of a spherical configuration.

15. The process cartridge according to claim 9, wherein one of the regulating portion and the regulated portion is a protrusion, and wherein the curved surface is in contact with the protrusion.

16. An image forming apparatus configured to form an image on a recording medium, comprising:

a drum unit having a photosensitive drum; and a developing unit having a developing roller and connected to the drum unit such that the developing unit is movable between a contact position where the developing roller is held in contact with the photosensitive drum and a separation position where the developing roller is separated from the photosensitive drum, wherein both in the case where the developing unit is at the contact position and in the case where the developing unit is at the separation position, a first regulating portion that the drum unit has and a first regulated portion that the developing unit has, are engaged with each other, whereby movement of the developing unit with respect to the drum unit in the axial direction of the developing roller is regulated, wherein the first regulating portion or the first regulated portion is a protrusion that protrudes in a direction crossing the axial direction from either one of the drum unit and the developing unit to the other unit, wherein in the case where the developing unit is at the separation position, a second regulating portion that the drum unit has and a second regulated portion that the developing unit has, overlap each other in a direction perpendicular to the axial direction, and wherein in the case where the developing unit is at the contact position, the second regulating portion and the second regulated portion do not overlap each other in the direction perpendicular to the axial direction.

17. The image forming apparatus according to claim 16, wherein the width in the axial direction of the second regulating portion is larger than the width in the axial direction of the first regulating portion.

18. The image forming apparatus according to claim 16, wherein when the developing unit is at the separation position, the length of the region where the second regulating portion and the second regulated portion are engaged with each other is shorter than the length of the region where the first regulating portion and the first regulated portion are engaged with each other.

19. The image forming apparatus according to claim 18, wherein, at the separation position, a gap in the axial direction between the first regulating portion and the first regulated portion is smaller than a gap in the axial direction between the second regulating portion and the second regulated portion.

20. An image forming apparatus configured to form an image on a recording medium, comprising:

a drum unit having a photosensitive drum;

a developing unit having a developing roller and connected to the drum unit such that the developing unit is movable between a contact position where the developing roller is held in contact with the photosensitive drum and a separation position where the developing roller is separated from the photosensitive drum;

a regulating portion provided on the drum unit; and a regulated portion provided on the developing unit and configured to be engaged with the regulating portion to regulate movement of the developing unit with respect to the drum unit in the axial direction of the developing roller, wherein at least one of the regulating portion and the regulated portion has a curved surface to be engaged with the other portion of the regulating portion and the regulated portion, wherein a one-end-side supported portion is provided at one end side of the developing unit in the axial direction of the developing roller, wherein the one-end-side supported portion is supported by the drum unit so as to be rotatable and slidable, wherein an other-end-side supported portion is provided at the other end side of the developing unit in the axial direction of the developing roller, and wherein the other-end-side supported portion is supported by the drum unit so as to be rotatable.

* * * * *